US011305549B2

(12) United States Patent
Ishizawa et al.

(10) Patent No.: US 11,305,549 B2
(45) Date of Patent: Apr. 19, 2022

(54) CONTAINER

(71) Applicant: SEIKO EPSON CORPORATION, Tokyo (JP)

(72) Inventors: Taku Ishizawa, Matsumoto (JP); Tadahiro Mizutani, Shiojiri (JP); Takuma Ozawa, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/943,224

(22) Filed: Jul. 30, 2020

(65) Prior Publication Data

US 2021/0031536 A1 Feb. 4, 2021

(30) Foreign Application Priority Data

Jul. 31, 2019 (JP) ..... JP2019-140998

(51) Int. Cl.
*B41J 2/175* (2006.01)

(52) U.S. Cl.
CPC ..... *B41J 2/17536* (2013.01); *B41J 2/17513* (2013.01); *B41J 2/17523* (2013.01); *B41J 2/17553* (2013.01)

(58) Field of Classification Search
CPC ..... B41J 2/17503; B41J 2/17509; B41J 2/17513; B41J 2/1752; B41J 2/17523; B41J 2/17536; B41J 2/1754; B41J 2/17553; B41J 2/17556; B41J 2/17566; B41J 2002/17516; B41J 2002/17573
See application file for complete search history.

(56) References Cited

U.S. PATENT DOCUMENTS

| | | | | |
|---|---|---|---|---|
| 6,435,638 | B1 * | 8/2002 | Wilson | B41J 2/17513 347/7 |
| 6,773,099 | B2 * | 8/2004 | Inoue | B41J 2/17556 347/86 |
| 8,210,670 | B2 * | 7/2012 | Ishizawa | B41J 2/17513 347/86 |
| 8,491,110 | B2 * | 7/2013 | Muto | B41J 2/17509 347/85 |
| 2007/0052771 | A1 * | 3/2007 | Inoue | B01F 11/04 347/86 |
| 2009/0290005 | A1 | 11/2009 | Wanibe et al. | |

FOREIGN PATENT DOCUMENTS

JP 2009-279886 A 12/2009

* cited by examiner

*Primary Examiner* — Anh T Vo
(74) *Attorney, Agent, or Firm* — Oliff PLC

(57) ABSTRACT

A container stores a fluid for use in an ink jet printer. The container includes: a casing that defines a storage space for storing the fluid, and has an opening communicating with the storage space; a film that covers the opening and seals the storage space; and a film attachment section that fixes the film to the casing. The casing includes a first surface that surrounds a periphery of the opening, and faces the film, and a second surface that surrounds the opening at a position farther from the opening than the first surface, has an angle intersecting the first surface, and faces the film, and the film attachment section is provided on the second surface.

16 Claims, 18 Drawing Sheets

CONTAINER

The present application is based on, and claims priority from JP Application Serial Number 2019-140998, filed Jul. 31, 2019, the disclosure of which is hereby incorporated by reference herein in its entirety.

BACKGROUND

1. Technical Field

The present disclosure relates to containers that store a fluid for use in ink jet printers.

2. Related Art

Containers that store a fluid for use in ink jet printers include one in which a casing that defines a storage space for storing the fluid has an opening, which is sealed by a film. For example, JP-A-2009-279886 discloses an ink cartridge which is an example of such a container. In the ink cartridge disclosed in JP-A-2009-279886, a sensor for detecting ink is disposed, and an opening of a recess that stores ink is sealed by a film.

In such a container, the film may be peeled from the casing due to, for example, an impact caused by dropping or the like, or repeated changes in pressure of fluid caused by driving of the ink jet printer. Such peeling of the film may occur not only in ink cartridges that store ink, but also, for example, in ink bottles that store ink for replenishment, or in other containers that store a fluid other than ink used in ink jet printers.

SUMMARY

According to an aspect of the present disclosure, a container that stores a fluid for use in an ink jet printer is provided. The container according to the aspect includes: a casing that defines a storage space for storing the fluid, and has an opening communicating with the storage space; a film that covers the opening and seals the storage space; and a film attachment section that fixes the film to the casing, wherein the casing includes a first surface that surrounds a periphery of the opening, and faces the film, and a second surface that surrounds the opening at a position farther from the opening than the first surface, has an angle intersecting the first surface, and faces the film, and the film attachment section is provided on the second surface, and the film is not fixed to the first surface.

DESCRIPTION OF EXEMPLARY EMBODIMENTS

Figure 1:
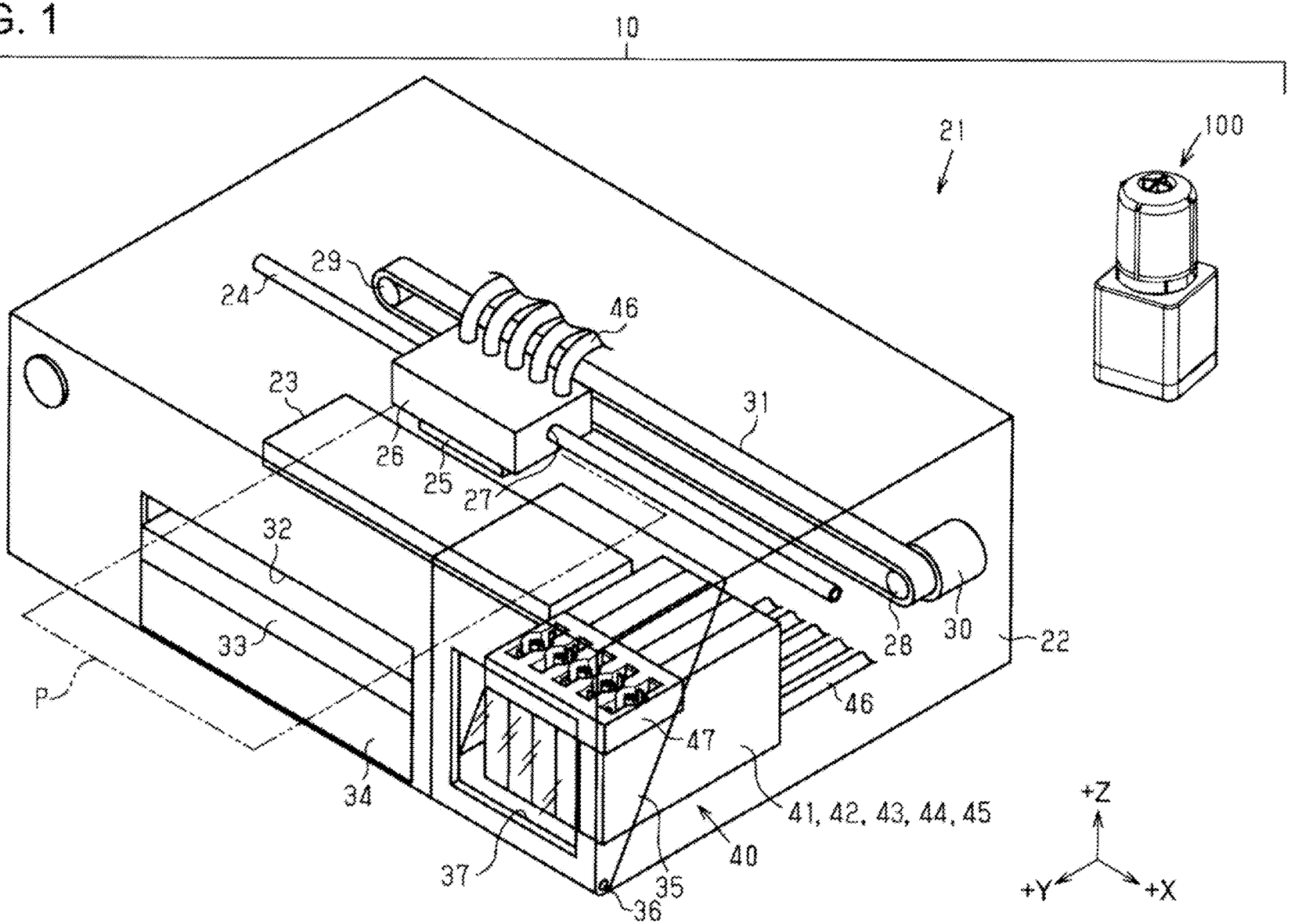
FIG. 1 is a schematic view illustrating a configuration of a printing system having a container.

1. First Embodiment 1-1. Overview of Printing System and Liquid Supplying System FIG. 1 is a schematic view illustrating a configuration of a printing system 10 having a container 100 according to a first embodiment. The printing system 10 includes an ink jet printer 21 that consumes liquid in addition to the container 100. The container 100 stores ink as an example of a fluid for use in the ink jet printer 21. In the printing system 10, ink in the container 100 is replenished to an ink supply unit 40 in the ink jet printer 21 by a user. In the following description, a configuration of the ink jet printer 21 is described with reference to FIGS. 1 and 2, and a configuration of the container 100 according to the first embodiment is described with reference to FIGS. 5 to 11.

1-2. Ink Jet Printer

FIG. 1 is a schematic perspective view which schematically illustrates a configuration of the inkjet printer 21. FIG. 1 is a schematic view of the ink jet printer 21 in which the configuration inside the housing 22 is shown in a see-through manner. In FIG. 1, the X direction, the Y direction, and the Z direction, which are mutually orthogonal, are indicated corresponding to the ink jet printer 21 disposed on a horizontal plane. The X direction and the Y direction are directions parallel to the horizontal direction, and the Z direction is a direction parallel to the vertical direction. The X direction corresponds to the left-right direction of the ink jet printer 21. In the X direction, the +X direction is the rightward direction facing the front of the ink jet printer 21, and the −X direction is the leftward direction. The Y direction corresponds to the front/rear direction of the ink jet printer 21. In the Y direction, the +Y direction is a forward direction, and the −Y direction is a backward direction. The Z direction corresponds to the up-down direction of the ink jet printer 21. In the Z direction, the +Z direction is an upward direction, and the −Z direction is a downward direction. In the drawings referred to in the following description, the X direction, the Y direction, and the Z direction are illustrated corresponding to FIG. 1.

The ink jet printer 21 records an image or the like on a medium by ejecting ink, which is an example of a liquid, onto the medium. Hereinafter, the ink jet printer 21 is also simply referred to as a "printer 21." The printer 21 includes the housing 22 having a cuboid shape, which has a longitudinal direction in the left-right direction. A support table 23 having a longitudinal direction in the left-right direction is disposed at a lower position in the housing 22 so as to extend in the left-right direction. The support table 23 serves as a platen, and a paper sheet P, which is an example of the medium, is transported forward in a sub scan direction while being supported on the upper surface of the support table 23. A guide shaft 24 extending in the left-right direction is disposed at a position above the support table 23 in the housing 22, and the guide shaft 24 supports a carriage 26, which is provided with a recording head 25 that ejects ink on the underside thereof. The carriage 26 has a support hole 27 penetrating in the left-right direction such that the guide shaft 24 is inserted therethrough. The carriage 26 can reciprocate in the left-right direction relative to the guide shaft 24.

A driving pulley 28 and a driven pulley 29 are rotatably supported in the housing 22 at positions near both ends of the guide shaft 24. The driving pulley 28 is joined to an output shaft of the carriage motor 30. An endless timing belt 31, partially joined to the carriage 26, is wound between the driving pulley 28 and the driven pulley 29. As the carriage 26 reciprocates in the left-right direction, which is a main scan direction, relative to the paper sheet P by driving of the carriage motor 30 while being guided by the guide shaft 24 via the timing belt 31, ink is ejected from the recording head 25 provided on the underside of the carriage 26 onto the paper sheet P transported forward on the support table 23.

An output port 32 having a rectangular shape is open to the front face of the housing 22 at a position facing the front of the support table 23 so that the paper sheet P on which recording has been performed is outputted through the output port 32. An output tray 33 having a rectangular plate shape for supporting the paper sheet P outputted from the housing 22 is provided in the output port 32. The output tray 33 is configured to be pulled forward. In the output port 32 under the output tray 33, a paper supply cassette 34 capable of accommodating a plurality of stacked paper sheets P is provided. The paper supply cassette 34 is detachable in the front/rear direction.

An opening/closing cover 35 is provided on the front face of the housing 22 at a position on the +X side relative to the output port 32. In FIG. 1, the opening/closing cover 35 is provided on the right end on the front face of the housing 22. The opening/closing cover 35 has rectangular front face and top face, and a right-angled triangular right face, and is configured to open/close by rotating in the front/rear direction about a rotation shaft 36, extending in the left-right direction, provided at the lower end of the opening/closing cover 35. A window 37 made of a transparent member is formed on the front face of the opening/closing cover 35 so that a user can see the inside of the housing 22 with the opening/closing cover 35 closed.

The ink supply unit 40 for supplying ink to the recording head 25 is housed in the housing 22 of the printer 21 at a position behind the opening/closing cover 35. In the first embodiment, the ink supply unit 40 includes five ink tanks 41, 42, 43, 44, and 45. Ink replenishment from the container 100 is performed by the user to each of the ink tank tanks 41, 42, 43, 44, and 45. It should be noted that the number of ink tanks is not limited to five. In other embodiments, the ink supply unit 40 may include only one ink tank, or may include less than five or more than five ink tanks.

Figure 2:
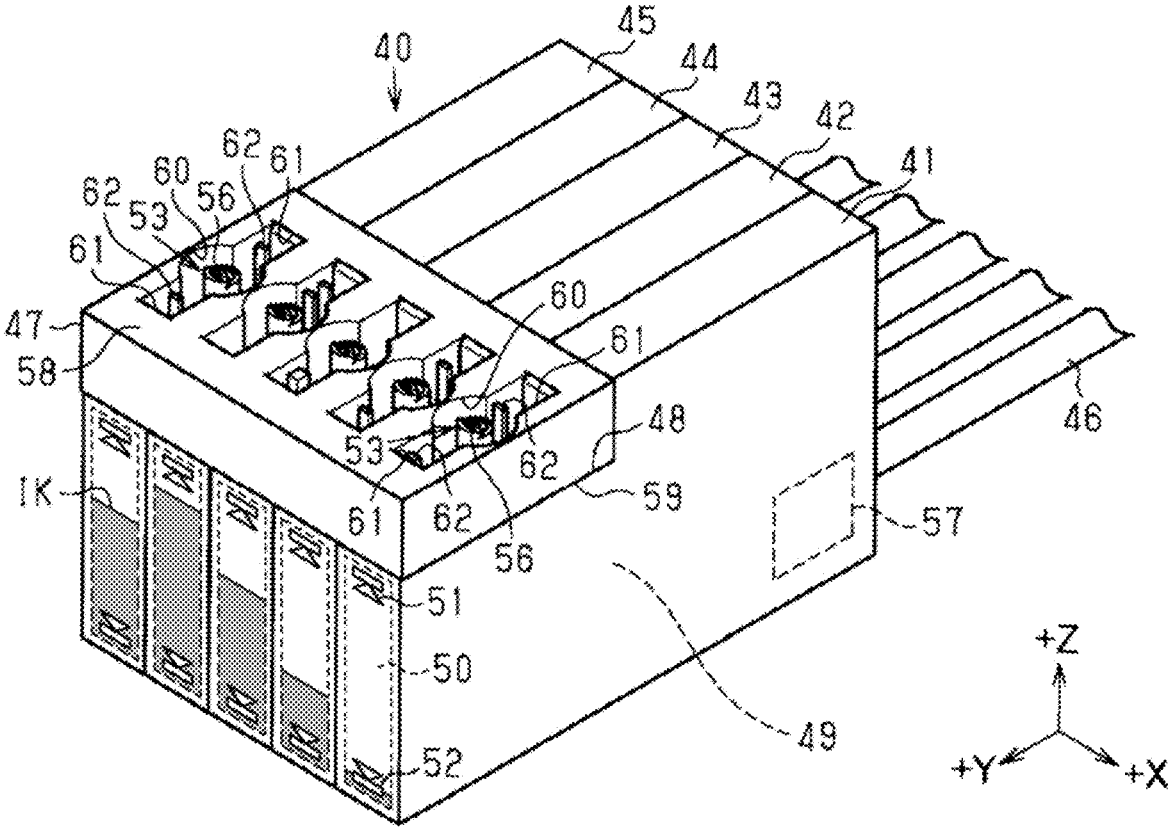
FIG. 2 is a schematic perspective view illustrating an ink supply unit.

FIG. 2 is a schematic perspective view illustrating the ink supply unit 40 of the printer 21. In addition to the ink tanks 41 to 45, the ink supply unit 40 further includes ink supplying tubes 46 extending from the rear faces of the ink tanks 41 to 45, and an adaptor 47 attached to the ink tanks 41 to 45 for ink replenishment. The adaptor 47 serves to communicate the container 100 with each of the ink tanks 41 to 45. Each of the ink tanks 41 to 45 is formed as a rectangular box shape having a smallest dimension in the left-right direction. The ink tanks 41 to 45 are coupled to the recording head 25 held by the carriage 26, which is shown in FIG. 1, via the ink supplying tubes 46, which are coupled to each of the ink tanks 41 to 45.

The ink tanks 41 to 45 are arranged side by side in the left-right direction, and joined as a unit when the adaptor 47 having a cuboid shape is attached to the ink tanks 41 to 45. Each of the ink tanks 41 to 45 has an adaptor attachment section 48 for attachment of the adaptor 47 at an upper front position. The adaptor attachment section 48 is formed as a stepped portion notched in a rectangular shape. As will be described later, in ink replenishment, the container 100 is fitted and joined to the adaptor 47. Further, the adaptor 47 may constitute part of the housing 22 that covers the ink tanks 41 to 45, or may be integrally formed with the ink tanks 41 to 45. In addition, the adaptor 47 may not necessarily have a function of joining the respective ink tanks 41 to 45, and may also be divided into each adaptor 47, which is attached to a respective one of the ink tanks 41 to 45.

The ink tanks 41 to 45 each have an ink storage chamber 49 for storing ink IK. The ink tanks 41 to 45 each store different colors of ink. For example, the ink tank 41 located on the right end stores black ink, and other ink tanks 42 to 45 arranged on the left side of the ink tank 41 each store ink other than black ink, for example, cyan, magenta, yellow, and the like.

An indicating section 50 is provided on the front wall of each of the ink tanks 41 to 45 so that the user can see the liquid level of the ink IK in the ink storage chamber 49 via the window 37 on the front face of the housing 22 shown in FIG. 1. The indicating section 50 is made of, for example, a transparent resin. In the indicating section 50, an upper limit mark 51 and a lower limit mark 52 that indicate guides for an upper limit and a lower limit, respectively, of the ink IK stored in the ink storage chamber 49 are provided. The upper limit mark 51 indicates, for example, a guide for the amount of ink IK that can be introduced without overflowing from the ink receiving section 53. The lower limit mark 52 indicates, for example, a guide for prompting the user to replenish the ink IK.

The ink tanks 41 to 45 are each provided with the ink receiving section 53 that allows ink externally supplied to flow into the ink storage chamber 49. The ink receiving section 53 includes a needle-shaped ink port 56 extending vertically upward from a horizontal portion of the adaptor attachment section 48. The ink port 56 includes two flow paths parallel to each other that communicate inside and outside of the ink storage chamber 49. The details of the two flow paths will be described later. A remaining amount sensor 57 for detecting the remaining amount of the ink IK in the ink storage chamber 49 is provided in the ink storage chamber 49 at a lower position close to the rear end of the ink storage chamber 49. The remaining amount sensor 57 may be omitted.

The adaptor 47 has a through hole vertically penetrating from an upper surface 58 to a lower surface 59. This through hole has an opening shape composed of a circular opening 60 having a substantially circular opening cross-section and a pair of rectangular openings 61 each having a substantially rectangular opening cross-section, which are continuous to the circular opening 60 on the front and rear sides thereof. The ink port 56 of each of the ink tanks 41 to 45 is positioned at the center of the circular opening 60. As will be described later, in ink replenishment from the container 100 to the ink tanks 41 to 45, a liquid outlet member 150 of the container 100 is partially fit in the circular opening 60 and rectangular openings 61. Further, the peripheries of the circular opening 60 and the rectangular openings 61 on the upper surface 58 of the adaptor 47 may be marked with the same color as that of ink stored in the corresponding ink tanks 41 to 45.

In the first embodiment, identification projections 62 protruding from an inner side face of the rectangular opening 61 are provided in the respective rectangular openings 61 at different positions for each of the ink tanks 41 to 45. As will be described later, the liquid outlet member 150 of the container 100 that stores color ink compatible to each of the ink tanks 41 to 45 has a groove 156 that is engageable with the identification projection 62. The identification projections 62 cannot be inserted into the groove 156 of the liquid outlet member 150 of the container 100 that stores incompatible color ink. Accordingly, the liquid outlet member 150 of such a container 100 is prevented from being inserted into the rectangular openings 61 of the adaptor 47.

1-3. Configuration of Container

Figure 3:
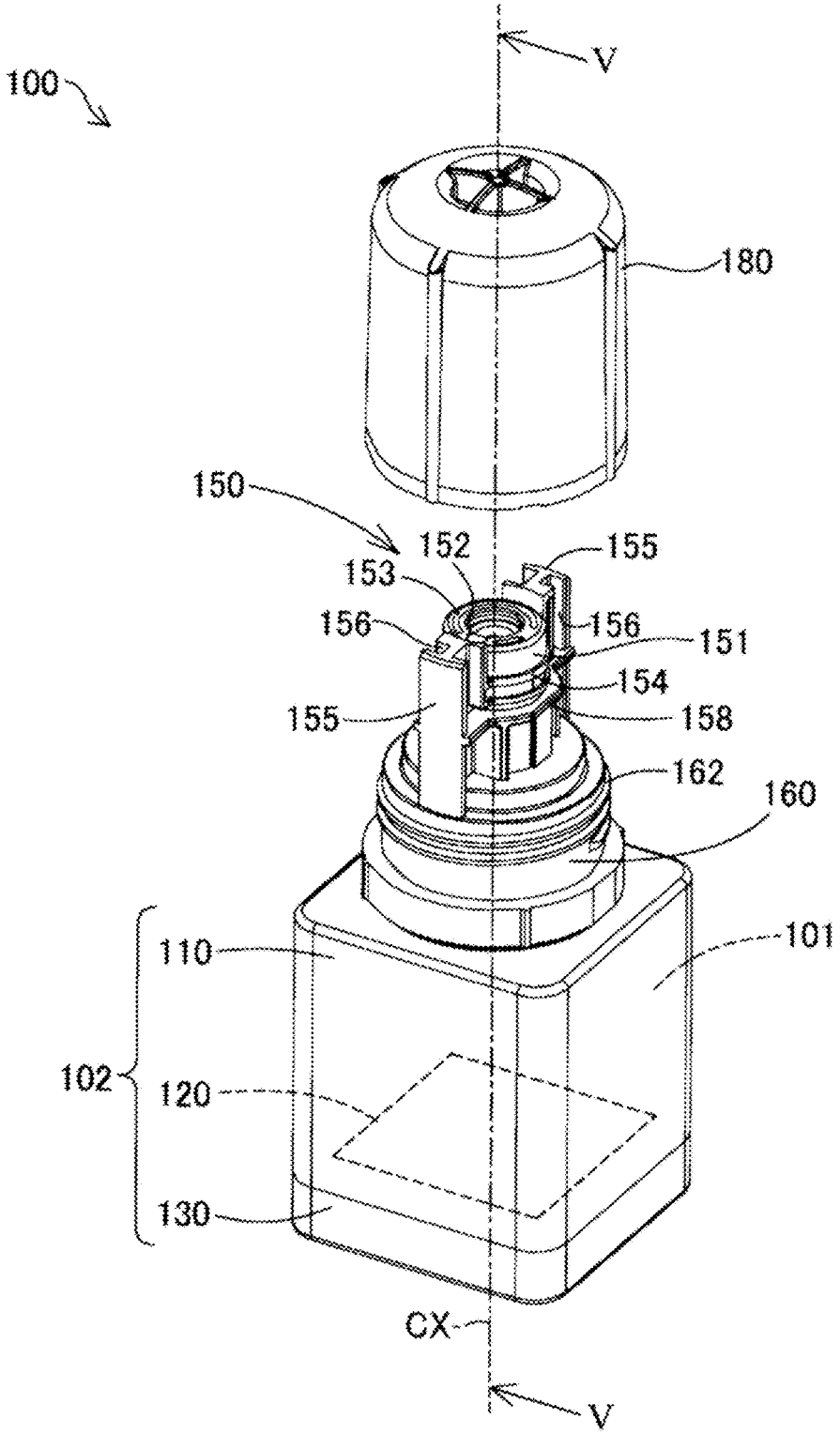
FIG. 3 is a schematic perspective view illustrating a container of a first embodiment.
Figure 4:
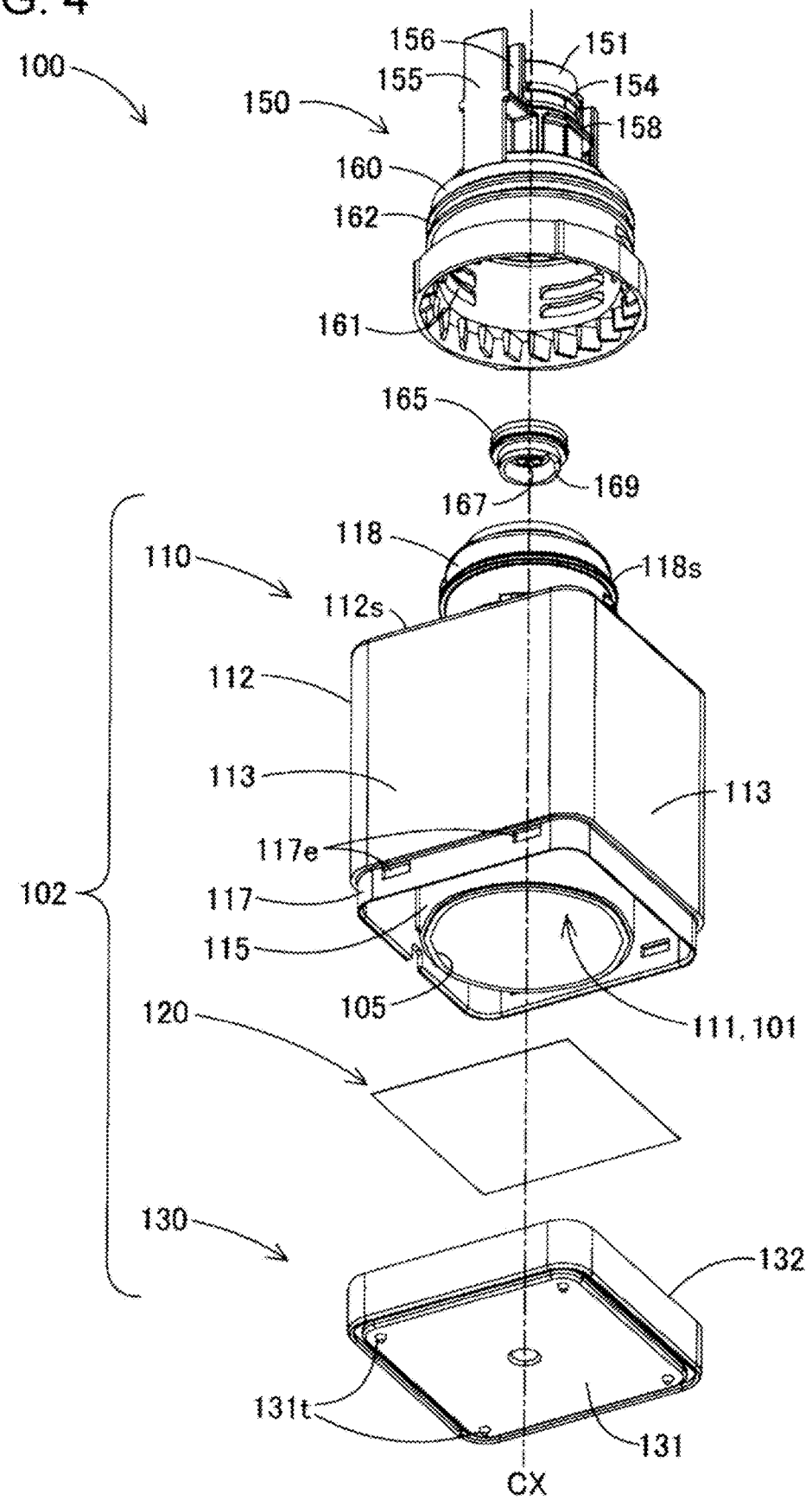
FIG. 4 is a schematic exploded perspective view illustrating a container of the first embodiment.
Figure 5:
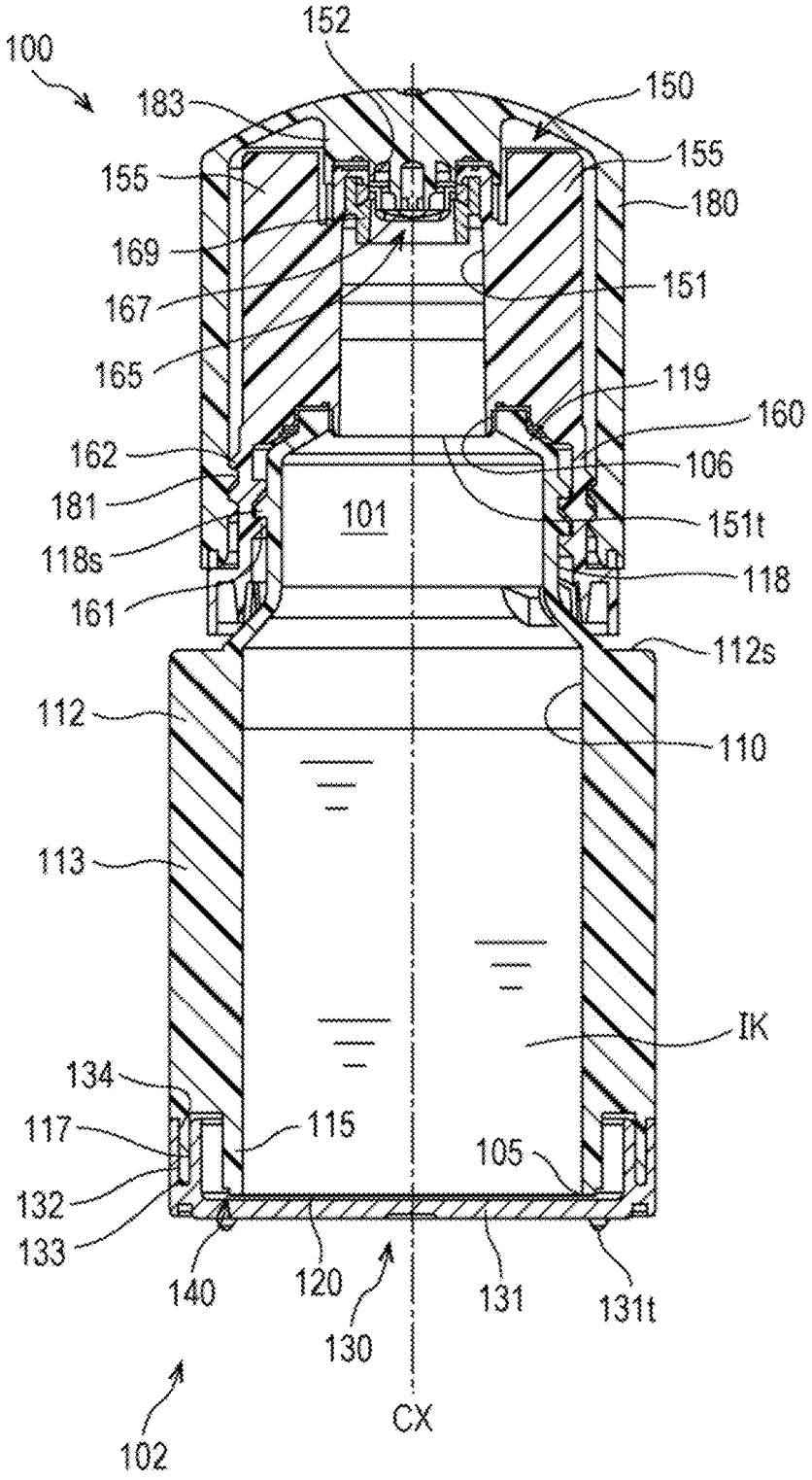
FIG. 5 is a schematic cross-sectional view illustrating a container of the first embodiment.

With reference to FIGS. 3 to 5, a configuration of the container 100 according to the first embodiment will be described. FIG. 3 is a schematic perspective view of the container 100 with the cap 180 being removed. FIG. 4 is a schematic exploded perspective view of the container 100. FIG. 5 is a schematic cross-sectional view of the container 100 taken along the line V-V which passes through a center axis center axis CX. FIG. 5 illustrates the container 100 with the cap 180 being attached. In FIGS. 3 to 5, the center axis CX of the container 100 is indicated by the dashed and dotted line. Hereinafter, the direction parallel with the center axis CX is referred to as a "center axis direction."

Reference will now be made to FIG. 3. The container 100 has an inner storage space 101 for storing ink. The container 100 includes a hollow container main body 102, the liquid outlet member 150 attached to container main body 102, and a cap 180 detachably attached to the liquid outlet member 150. Hereinafter, an end of the container 100 in the center axis direction on which the liquid outlet member 150 is provided is referred to as a "distal end side," whereas the other end is referred to as a "proximal end side."

1-3-1. Container Main Body

Reference will now be made to FIGS. 3, 4 and 5. The container main body 102 includes a casing 110 that defines the storage space 101, a film 120 that seals the storage space 101 at the proximal end side of the casing 110, and a cover 130 that covers the film 120 and constitutes the proximal end of the container 100. As shown in FIGS. 4 and 5, the casing 110 is formed of a cylindrical member having a through hole 111 penetrating therethrough in the center axis direction. The through hole 111 defines the storage space 101. In the first embodiment, the through hole 111 has a substantially circular opening cross-section. The casing 110 is formed by, for example, injection molding of resin materials such as polypropylene (PP) and polyethylene terephthalate (PET).

As shown in FIGS. 4 and 5, the casing 110 includes a casing main body 112 having a quadrangular prism-shaped appearance, and a distal end attachment section 118 of a substantially cylindrical shape which protrudes from an upper surface 112*s* on the distal end of the casing main body 112 and to which the liquid outlet member 150 is attached. As shown in FIG. 5, the through hole 111 penetrates the casing main body 112 and the distal end attachment section 118.

As shown in FIGS. 4 and 5, the casing main body 112 includes an outer wall 113 that surrounds the through hole 111, and constitutes the outer wall of the casing main body 112. The outer wall of the outer wall 113 constitutes the side wall of the container main body 102. As shown in FIG. 4, a peripheral wall 115 and a fitting wall 117 are provided on the proximal end of the outer wall 113.

As shown in FIG. 4, the peripheral wall 115 is a cylindrical wall that surrounds the opening 105 on the proximal end of the through hole 111, and extends in the center axis direction, which is an opening direction of the opening 105. As shown in FIG. 5, the distal end of the peripheral wall 115 is joined to the outer wall 113.

As shown in FIGS. 4 and 5, the film 120 is fixed to the proximal end of the peripheral wall 115 to seal the opening 105. The film 120 is formed of a flexible thin film member. The film 120 is made of, for example, polypropylene or polyethylene terephthalate. As shown in FIG. 5, a film attachment section 140 is provided on the proximal end of the peripheral wall 115 so as to fix the film 120 to the casing 110. The film attachment section 140 is formed surrounding the opening 105. The details of the film attachment section 140 will be described later.

As shown in FIG. 4, the fitting wall 117 is provided on the outside of the peripheral wall 115 when viewed from the center axis CX, and surrounds the peripheral wall 115. The fitting wall 117 functions as a fixation section of the cover 130. The fitting wall 117 has a reduced thickness than the outer wall 113, and is configured to be inserted and fitted into a gap 134 of the cover 130, which will be described later. The wall of the fitting wall 117 is provided with an engaging section 117*e* configured to engage with a claw (not shown) provided in the gap 134 of the cover 130.

As shown in FIGS. 4 and 5, the cover 130 has a lower wall 131 that faces the film 120 and constitutes the planar bottom of the container 100. The container 100 is configured to stand alone on a horizontal plane with the lower wall 131 as the bottom. As shown in FIG. 4, in the first embodiment, the lower wall 131 has a substantially square shape. On the proximal end surface of the lower wall 131, projections 131*t* are provided as legs at four corners.

As shown in FIG. 5, the lower wall 131 has an outer side wall 132 and an inner side wall 133 on the peripheral portion. The outer side wall 132 extends in the center axis direction and constitutes the proximal end portion of the side wall of the container main body 102, while the inner side wall 133 is surrounded by the outer side wall 132 and extends in the center axis direction parallel to the outer side wall 132. The cover 130 is fixed to the casing main body 112 when the fitting wall 117 of the casing main body 112 is inserted and fitted in the gap 134 between the outer side wall 132 and the inner side wall 133.

As shown in FIGS. 4 and 5, an external thread section 118*s* for fixing the liquid outlet member 150 is provided on the outer periphery of the distal end attachment section 118. Further, as shown in FIG. 5, the distal end attachment section 118 has a reduced diameter section 119 whose diameter is reduced toward the distal end. A distal end opening 106 of the through hole 111 is open at the distal end of the reduced diameter section 119. The outer peripheral surface of the distal end attachment section 118 is surrounded by a connecting section 160 of the liquid outlet member 150.

1-3-2. Liquid Outlet Member

Reference will now be made to FIGS. 3 and 4. The liquid outlet member 150 is a member that serves as a spout, and attached to the distal end portion of the container 100. The liquid outlet member 150 is a cylindrical member, and is formed by injection molding of resin materials such as polypropylene and polyethylene terephthalate.

As shown in FIGS. 3 and 4, the liquid outlet member 150 has a conduit 151 that communicates with the storage space 101 at the distal end. In the first embodiment, the conduit 151 has a cylindrical shape extending in the center axis CX. The conduit 151 has a diameter capable of fitting in the circular opening 60 of the adaptor 47 shown in FIG. 2. As shown in FIGS. 3 and 5, the conduit 151 has an outlet port 152 at a distal end portion so that the ink IK stored in the storage space 101 flows out therethrough. In the first embodiment, the center of the outlet port 152 is located on the center axis CX of the container 100. As shown in FIG. 5, a proximal end 151*t* of the conduit 151 is fitted in the distal end opening 106 of the distal end attachment section 118. Accordingly, a flow path space in the conduit 151 communicates with the through hole 111 of the casing 110. The flow path space in the conduit 151 can be regarded as forming part of the storage space 101.

Reference will now be made to FIG. 3. A peripheral groove 153 is formed on the outer periphery of the outlet port 152 on the distal end face of the conduit 151. In the container 100, after ink replenishment for the ink tanks 41 to 45, ink attached to the periphery of the outlet port 152 can be allowed to flow into the peripheral groove 153 and to be stored therein before dripping on the side face of the conduit 151. Accordingly, ink attached to the periphery of the outlet port 152 is prevented from dripping on the side face of the conduit 151.

As shown in FIGS. 3 and 4, an annular projection 154 that protrudes in the radial direction of the conduit 151 and extend along the outer periphery of the conduit 151 is provided on the outer peripheral surface of the conduit 151. The annular projection 154 can block the ink spilled from the outlet port 152 from flowing down the side face of the conduit 151 toward the proximal end side. In this specification, a "radial direction" of a tubular or cylindrical member refers to a direction perpendicular to the center axis of the tubular or cylindrical member.

As shown in FIGS. 3 and 4, the liquid outlet member 150 further includes a pair of fitting sections 155 on both sides in the radial direction of the conduit 151. The pair of fitting sections 155 are formed to fit in the corresponding rectangular openings 61 of the adaptor 47 shown in FIG. 2. In the first embodiment, the fitting section 155 is formed as a rectangular columnar member extending along the conduit 151. The groove 156 extending along the conduit 151 is provided on the side face of the fitting section 155. The groove 156 is configured such that the compatible identification projection 62 in the rectangular opening 61 shown in FIG. 2 can be inserted. Further, the pair of fitting sections 155 and the grooves 156 may be omitted.

As shown in FIGS. 3 and 4, the liquid outlet member 150 further includes a positioning section 158 that extends in the radial direction on the side faces of the conduit 151 and the fitting section 155. The positioning section 158 has an upper surface facing the distal end side and extending along the radial direction. When the container 100 is joined to the adaptor 47 in an ink replenishment step for the ink tanks 41 to 45, which will be described later, the upper surface of the positioning section 158 abuts the upper surface 58 of the adaptor 47 at the periphery of the circular opening 60 and the rectangular openings 61. Thus, positioning of the container 100 in ink replenishment for the ink tanks 41 to 45 is performed.

Reference will now be made to FIGS. 3 to 5. The liquid outlet member 150 has the connecting section 160 provided on the proximal end side of the positioning section 158 for fixing the liquid outlet member 150 to the container main body 102. The connecting section 160 is formed as a cylindrical portion having a diameter larger than that of the conduit 151. As shown in FIGS. 4 and 5, the inner peripheral surface of the connecting section 160 has an internal thread section 161 configured to threadedly engage with an external thread section 118*s* provided on the outer periphery of the container main body 102. As shown in FIGS. 3 to 5, the outer peripheral surface of the connecting section 160 has an external thread section 162 for detachably attaching the cap 180 to the container 100.

As shown in FIGS. 4 and 5, a valve member 165 is attached inside the liquid outlet member 150. The valve member 165 is a valve that opens when the ink port 56 of the ink tanks 41 to 45 is inserted into the outlet port 152 of the liquid outlet member 150. In the first embodiment, the valve member 165 is configured as a slit valve. The main body of the valve member 165 is made of an elastic member such as a silicone film, and has a slit 167 that opens and closes by being elastically deformed in the thickness direction at the center. The valve member 165 is inserted into the liquid outlet member 150 from the proximal end side as shown in FIG. 4, and is attached to the distal end side of the conduit 151 as shown in FIG. 5 with the slit 167 being positioned in the outlet port 152. The valve member 165 is held between the peripheral portion of the outlet port 152 and an annular holding member 169. The valve member 165 is fixed to the distal end side of the positioning section 158.

1-3-3. Cap

Reference will now be made to FIGS. 3 and 5. The cap 180 is formed of a cylindrical member having a closed distal end, and the other end which is open. The cap 180 is formed by, for example, injection molding of resin materials such as polypropylene and polyethylene terephthalate. The cap 180 is attached to the distal end side of the container 100 with the liquid outlet member 150 being housed inside. As shown in FIG. 5, the inner peripheral surface of the cap 180 has an internal thread section 181 configured to threadedly engage with the external thread section 162 provided on the connecting section 160 of the liquid outlet member 150. Further, a closing section 183 for closing the outlet port 152 is provided on the inner wall surface of the cap 180 at a position facing the outlet port 152 of the liquid outlet member 150. Providing the cap 180 protects the liquid outlet member 150, and prevents ink leakage from the outlet port 152.

1-4. Ink Replenishment for Ink Tank

Figure 6:
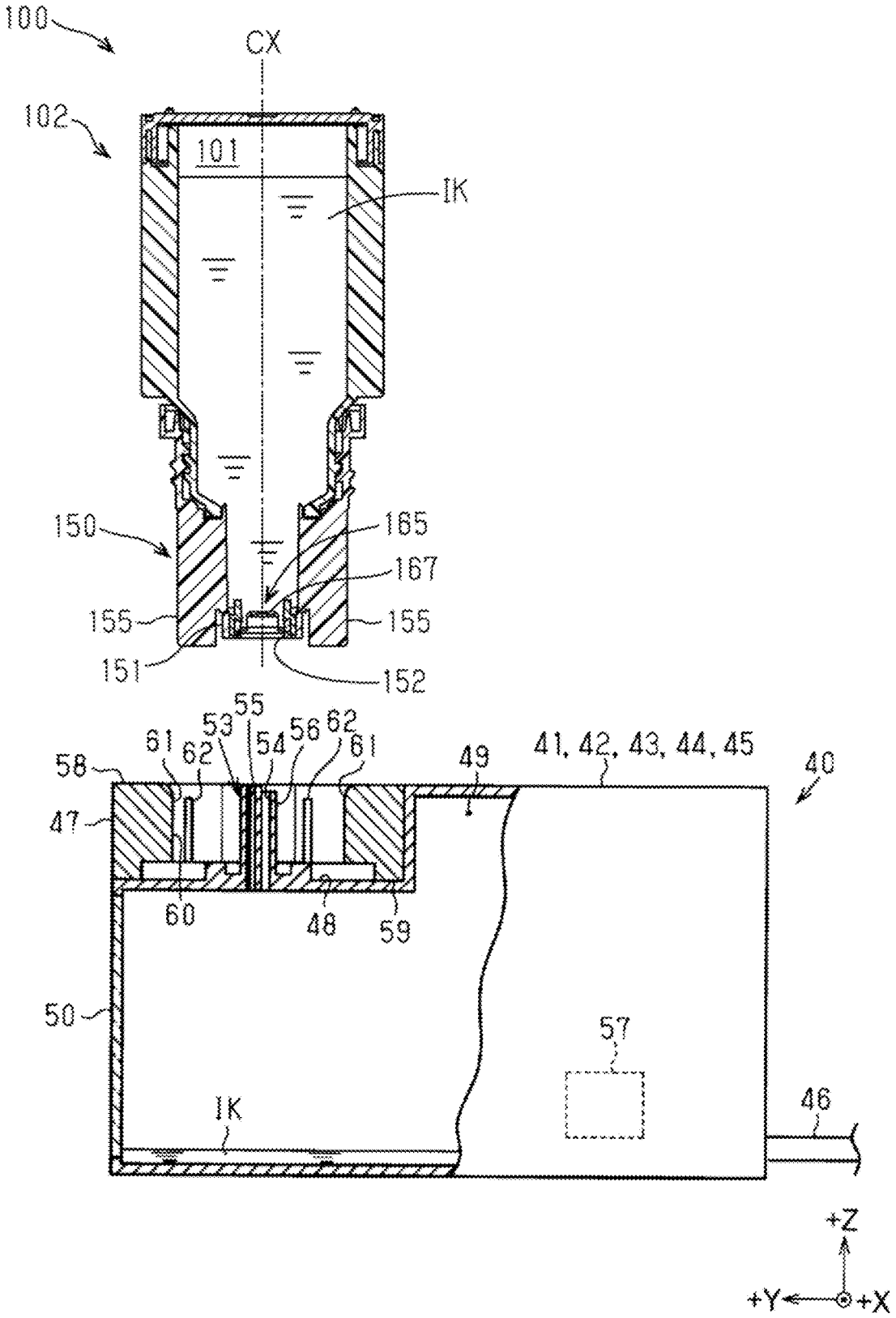
FIG. 6 is a first explanatory view illustrating an ink replenishment step for an ink tank.
Figure 7:
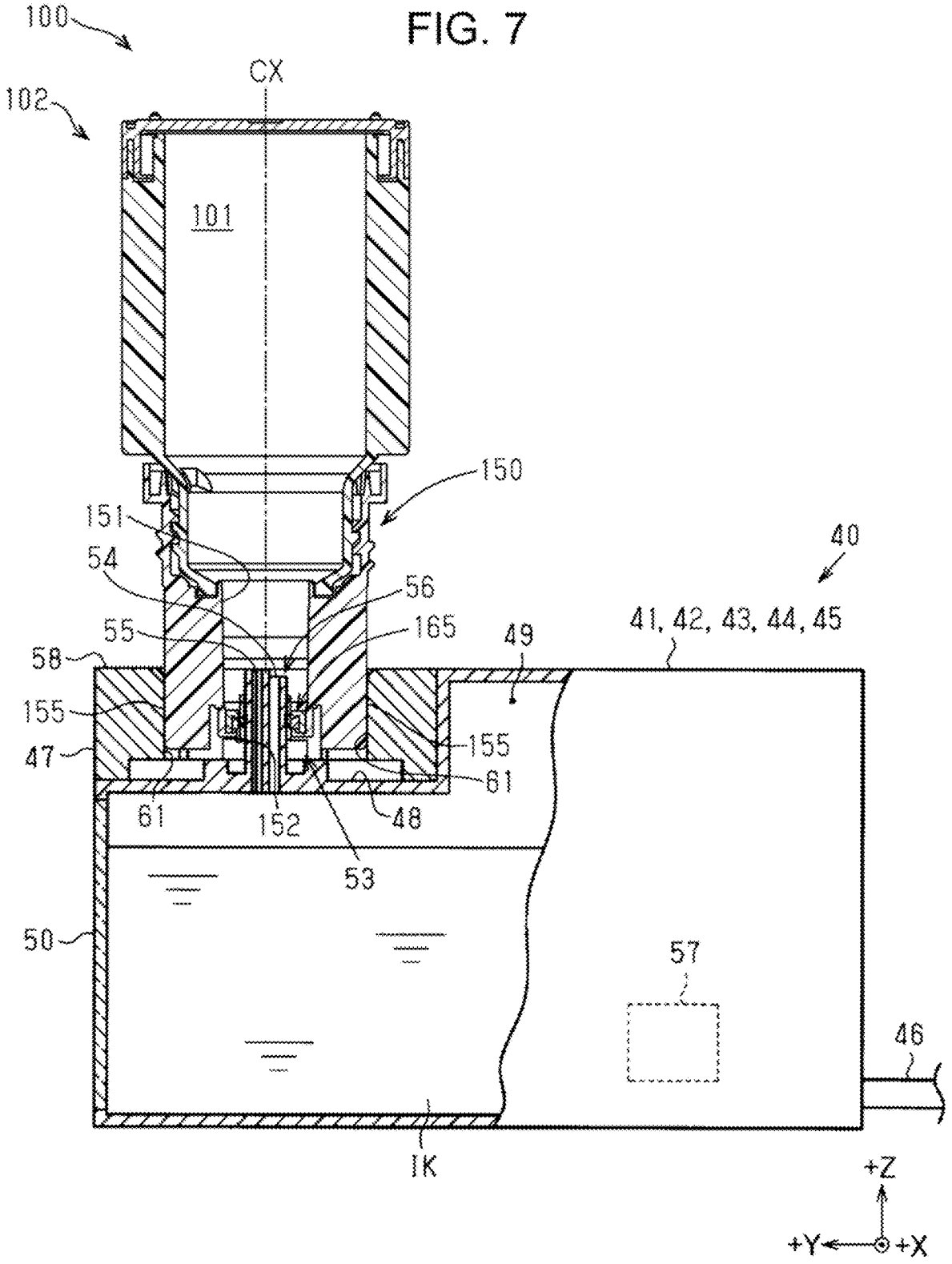
FIG. 7 is a second explanatory view illustrating an ink replenishment step for an ink tank.

With reference to FIGS. 6 and 7, a step of replenishing ink from the container 100 to the ink tanks 41 to 45 will be described. FIG. 6 is a partial cutaway side view schematically illustrating a state before the container 100 is coupled to the adaptor 47. FIG. 7 is a partial cutaway side view schematically illustrating a state after the container 100 is coupled to the adaptor 47. In FIGS. 6 and 7, the X direction, the Y direction, and the Z direction are indicated corresponding to FIGS. 1 and 2. Ink replenishment for the ink tanks 41 to 45 is performed, for example, when the user recognizes via the indicating section 50 that the liquid level of the ink IK is at or lower than the lower limit mark 52.

Reference will now be made to FIG. 6. First, the container 100 is set in a posture with the distal end down and the proximal end up while the center axis CX corresponds to the Z direction. Further, the pair of fitting sections 155 of the liquid outlet member 150 in the container 100 are positioned in the front/rear direction of the ink tanks 41 to 45. This posture of the container 100 may also be referred to as a "liquid introducing posture." Since the slit 167 of the valve member 165 is in a closed state before the container 100 is coupled to the adaptor 47, the valve member 165 prevents ink from flowing out through the outlet port 152 even if the distal end of the container 100 is oriented in the direction of gravity.

Then, the outlet port 152 of the container 100 is positioned above the ink port 56 of the ink tanks 41 to 45, and the container 100 in the liquid introducing posture is moved downward. Accordingly, as shown in FIG. 7, the conduit 151 of the liquid outlet member 150 is inserted into the circular opening 60 of the adaptor 47, while the fitting sections 155 of the liquid outlet member 150 are fit in the corresponding rectangular openings 61 of the adaptor 47. Here, as the positioning section 158 of the liquid outlet member 150 shown in FIG. 3 abuts the peripheral portion of the circular opening 60, the container 100 is positioned in the Z direction with respect to the adaptor 47. Further, when the container 100 is attempted to be coupled to the ink tanks 41 to 45 of incompatible color ink, the identification projections 62 provided in the rectangular openings 61 cannot be inserted in the grooves 156 provided in the fitting sections 155 shown in FIG. 3. Therefore, the container 100 is prevented from being erroneously coupled to the ink tanks 41 to 45 of incompatible color ink.

When the liquid outlet member 150 is inserted into the circular opening 60 and the rectangular openings 61 of the adaptor 47, the ink port 56 located at the center of the circular opening 60 is inserted into the outlet port 152 in the +Z direction through the slit 167 of the valve member 165. The ink port 56 has two parallel flow paths 54 and 55 extending in the Z direction. When the ink port 56 is inserted into the outlet port 152, the ink IK starts flowing into the ink storage chamber 49 via at least one of two flow paths 54 and 55. As the ink IK flows into the ink storage chamber 49, pressure of air in the ink storage chamber 49 increases. Accordingly, air in the ink storage chamber 49 starts flowing into the storage space 101 of the container 100 via one of two flow paths 54 and 55. As a consequence, the ink IK in the container 100 and air in the ink storage chamber 49 are automatically exchanged without requiring the user to perform an operation such as squeezing the container main body 102 of the container 100, and the ink IK in the ink storage chamber 49 is replenished. The flow path resistances and the distal end positions of two flow paths 54 and 55 are adjusted so that one of these serves as an air flow path and the other serves as an ink flow path as described above.

1-5. Film Attachment Section

Figure 8:
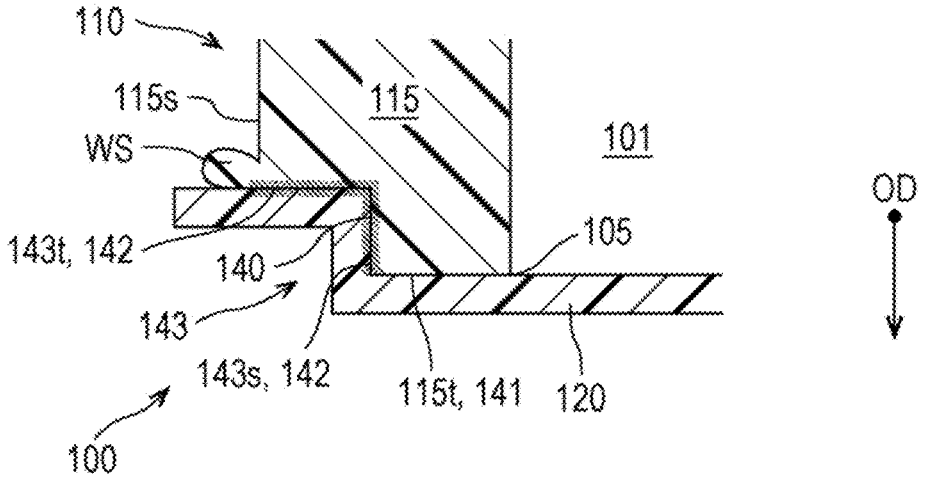
FIG. 8 is a schematic cross-sectional view illustrating a film attachment section of the first embodiment.

FIG. 8 is a schematic cross-sectional view illustrating a film attachment section 140 of the container 100. FIG. 8 indicates an opening direction OD of the opening 105 directing from inside to the outside of the casing 110. The opening direction OD is a direction toward the outside of the storage space 101 via the opening 105, perpendicular to the virtual plane including the outer peripheral edge of the opening 105. In the first embodiment, the opening direction OD is parallel to the center axis direction.

As described above, the film attachment section 140 is provided on the proximal end of the peripheral wall 115 of the casing 110 so as to fix the film 120 to the casing 110. The peripheral wall 115 of the casing 110 includes a first surface 141 and a second surface 142, which will be described later, and the film attachment section 140 is provided on the second surface 142.

The peripheral wall 115 extends in the opening direction OD. The peripheral wall 115 has an end face **115*t* oriented in the opening direction OD at the proximal end, and an outer peripheral surface 115*s* on a side of the peripheral wall 115 opposite to that facing the storage space 101. The outer peripheral surface 115*s* is a wall extending in the opening direction OD, and intersects the end face 115*t*. In this specification, two surfaces "intersect" means any of states where (i) two surfaces actually intersect each other, (ii) a virtually extended portion of one surface intersect the other surface, and (iii) virtually extended portions of each of two surfaces intersect each other. In the first embodiment, the outer peripheral surface 115*s* and the end face 115*t*** intersect each other in the state described in (iii).

A stepped portion 143 is formed between the end face **115*t* and the outer peripheral surface 115*s* at the proximal end of the peripheral wall 115. The stepped portion 143 corresponds to a notched portion of a corner between the end face 115*t* and the outer peripheral surface 115*s*. The stepped portion 143 includes a step bottom 143*t* and a step side face 143*s*. The step bottom 143*t* is a wall located at a position separated from the end face 115*t* in a direction opposite to the opening direction OD, that is, in a direction directing from the film 120 toward the casing 110, and facing the opening direction OD. The step side face 143*s* is a wall located between the end face 115*t* and the step bottom 143*t*, and intersecting the step bottom 143*t***.

The end face **115*t*, the step bottom 143*t*, and the step side face 143*s* surround the opening 105. Further, the end face 115*t*, the step bottom 143*t*, and the step side face 143*s* are in contact with the outer periphery portion of the film 120, and are covered with the film 120**.

In the first embodiment, the end face **115*t* of the peripheral wall 115 corresponds to the "first surface 141," and the step bottom 143*t* and the step side face 143*s* of the stepped portion 143 correspond to the "second surface 142." The first surface 141 surrounds the periphery of the opening 105, and faces the film 120. The second surface 142 surrounds the opening 105 at a position farther from the opening 105 than the first surface 141, has an angle intersecting the first surface 141, and faces the film 120**.

The film 120 is in contact with the first surface 141, but not fixed thereto. The film attachment section 140 is configured as a joining portion that joins the film 120 and the second surface 142. In the first embodiment, the film 120 and the second surface 142 are joined by welding, and the film attachment section 140 is configured as a welding portion. There may be a case where a part of the peripheral wall 115 is melted, sags and hardens on the periphery of the step bottom 143*t* to form a weld sag WS during welding. In the container 100, the weld sag WS may be removed.

Figure 9A:
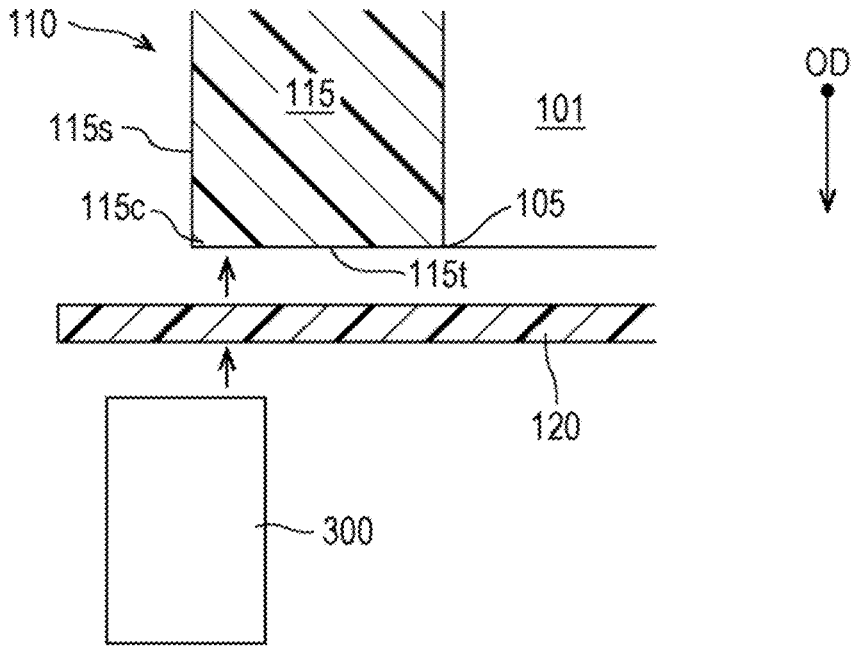
FIG. 9A is a first schematic diagram illustrating a method of forming a film attachment section of the first embodiment.
Figure 9B:
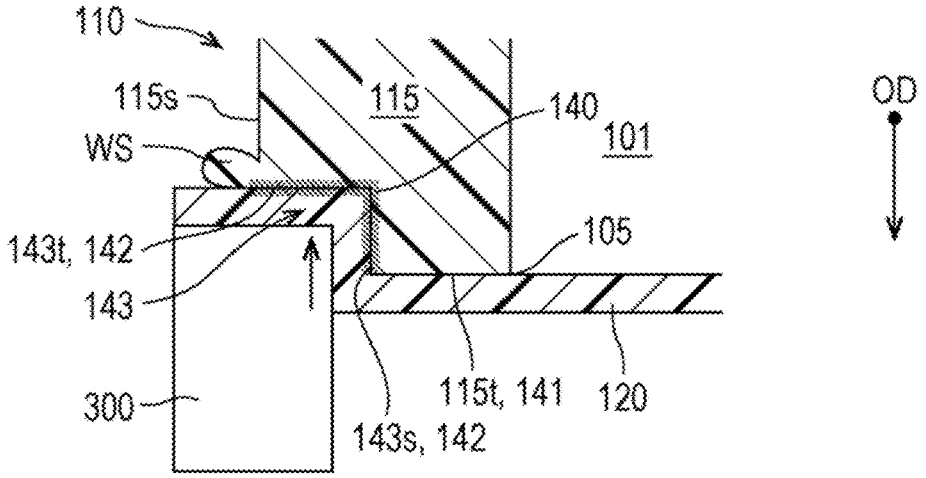
FIG. 9B is a second schematic diagram illustrating a method of forming a film attachment section of the first embodiment.

FIGS. 9A and 9B are schematic diagrams illustrating a method of forming the film attachment section 140 in the order of steps. In the first step, as shown in FIG. 9A, the film 120 is positioned on the end face 115*t* of the peripheral wall 115 so as to cover the opening 105. At this stage, the stepped portion 143 is not formed, and the end face 115*t* and the outer peripheral surface 115*s* intersect each other at a corner 115*c*.

In the second step, as shown in FIG. 9A, a heat generating element 300 is heated to a temperature equal to or higher than the melting point of the resin material for forming the peripheral wall 115, and pressed against the corner 115*c* of the peripheral wall 115 with the film 120 interposed therebetween. Here, a portion of the end face 115*t* outside the portion forming the first surface 141 is heated and pressed by using a rectangular portion of the heat generating element 300. Accordingly, as shown in FIG. 9B, a portion forming the corner 115*c* is melted and form the stepped portion 143 such that the film 120 is welded to the step side face 143*s* and the step bottom 143*t* which form the second surface 142. Through the steps described above, the film attachment section 140 is formed in the container 100.

Figure 10:
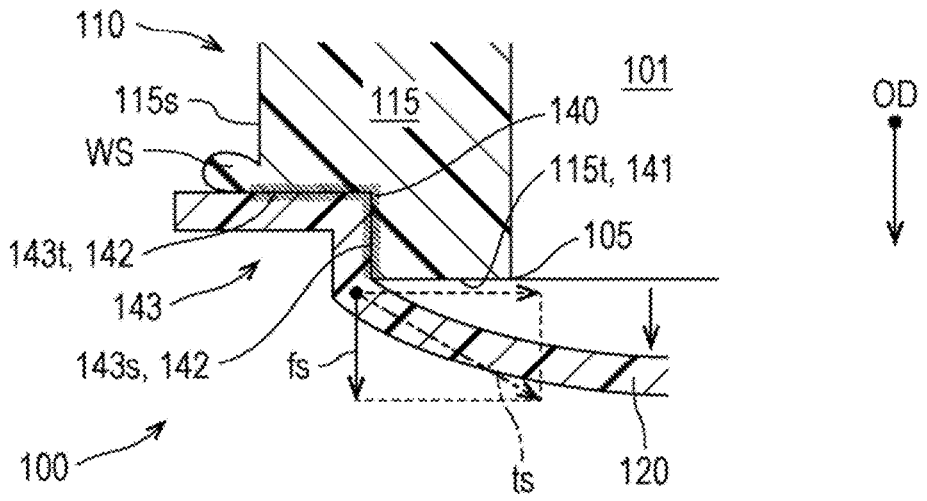
FIG. 10 is a schematic view illustrating a mechanism when a film is flexibly deformed.

With reference to FIG. 10, a mechanism when the film 120 is flexibly deformed will be described. There may be a case where the film 120 is flexibly deformed by an external force caused by, for example, water impact of ink or the like due to dropping of the container 100. As described above, the film 120 is not fixed to the first surface 141 at the end face 115*t*. Therefore, when the film 120 receives an external force at the center portion in a direction away from the casing 110, the film 120 flexes in a direction away from the first surface 141 while the outer periphery portion of the film 120 is fixed to the film attachment section 140 of the second surface 142. Here, the film attachment section 140 receives a force fs in a shear direction along the step side face 143*s*, that is, the second surface 142 by a tensile stress is toward the center of the film 120 in the film attachment section 140. Usually, the welding portion has high durability against a force in the shear direction acting on two welded objects. Accordingly, the film attachment section 140 provided on the second surface 142 exhibits high durability against a force fs in the shear direction. Therefore, in the container 100, it is possible to prevent breakage of the film attachment section 140 and peeling of the film 120 from the casing 110 due to a stress generated by flexible deformation of the film 120.

Further, when the film 120 is flexibly deformed in a direction opposite to the opening direction OD, the film 120 is received by the first surface 141, and a tensile stress along the first surface 141 is applied to the film 120. This tensile stress acts on the film attachment section 140 provided on the second surface 142 as a force in the shear direction along the second surface 142. Therefore, even when the container 120 is flexibly deformed in a direction opposite to the opening direction OD, it is possible to prevent breakage of the film attachment section 140 and peeling of the film 120 from the casing 110 due to a stress generated by flexible deformation of the film 120.

Figure 11:
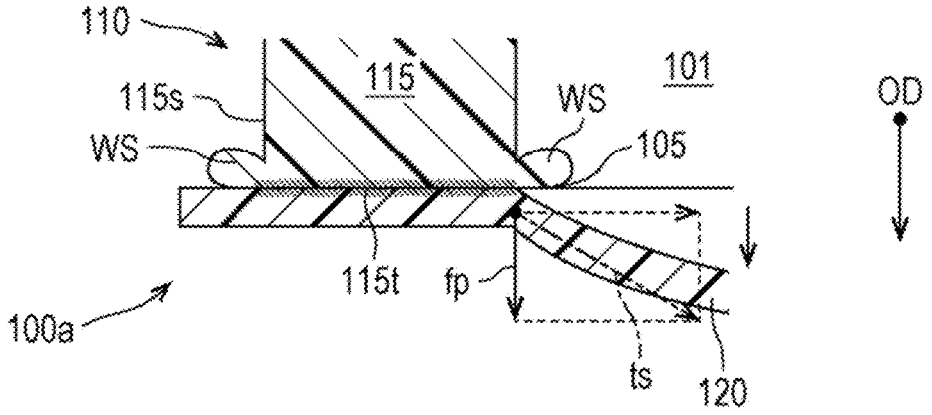
FIG. 11 is a schematic view illustrating a configuration of a comparative example.

With reference to FIG. 11, a mechanism when the film 120 in a container 100*a* of a comparative example is flexibly deformed will be described. The configuration of the container 100*a* of the comparative example is substantially the same as the configuration of the container 100 of the first embodiment except that the stepped portion 143 is not formed and the film 120 is welded to the entirety of the end face 115*t* of the peripheral wall 115. In the container 100*a* of the comparative example, when center portion of the film 120 is flexibly deformed in a direction away from the casing 110, the film attachment section 140 receives a force fp in a peeling direction in which the film 120 is detached from the end face 115*t* of the peripheral wall 115 by a tensile stress is generated on the film 120. Usually, the durability against a force in the peeling direction of the welding portion is lower than the durability against a force in the shear direction described above. Therefore, in the case of the container 100*a* of the comparative example, the film 120 is more likely to be peeled from the casing 110 due to flexible deformation of the film 120 compared with the container 100 of the first embodiment.

1-6. Summary of First Embodiment

As described above, according to the container 100 of the first embodiment, the film 120 is not fixed to the first surface 141 of the casing 110, and the film attachment section 140 is provided on the second surface 142 of the casing 110. With this configuration, the durability of the film attachment section 140 against the stress generated by flexible deformation of the film 120 is increased, and the film 120 is prevented from being peeled from the casing 110.

According to the container 100 of the first embodiment, the film attachment section 140 is provided at a notched portion of the corner 115*c* between the outer peripheral surface 115*s* and the end face 115*t* of the peripheral wall 115. Since such a portion can be easily accessed by a tool such as the heat generating element 300 for forming the film attachment section 140, formation of the film attachment section 140 can be easier. Furthermore, according to the container 100 of the first embodiment, the first surface 141 is located on the end face 115*t* of the peripheral wall 115, and the second surface 142 is located on the step side face 143*s* and the step bottom 143*t* located on a side in the direction from the film 120 toward the casing 110. With this configuration, the film attachment section 140 can be formed on the second surface 142 while the film 120 is not fixed to the first surface 141.

According to the container 100 of the first embodiment, the second surface 142 on which the film attachment section 140 is provided is composed of the step side face 143*s* and the step bottom 143*t* of the stepped portion 143. With this configuration, since the film 120 is fixed to the step bottom 143*t* in addition to the step side face 143*s*, the film 120 is further prevented from being peeled from the casing 110.

2. Second Embodiment

Figure 12:
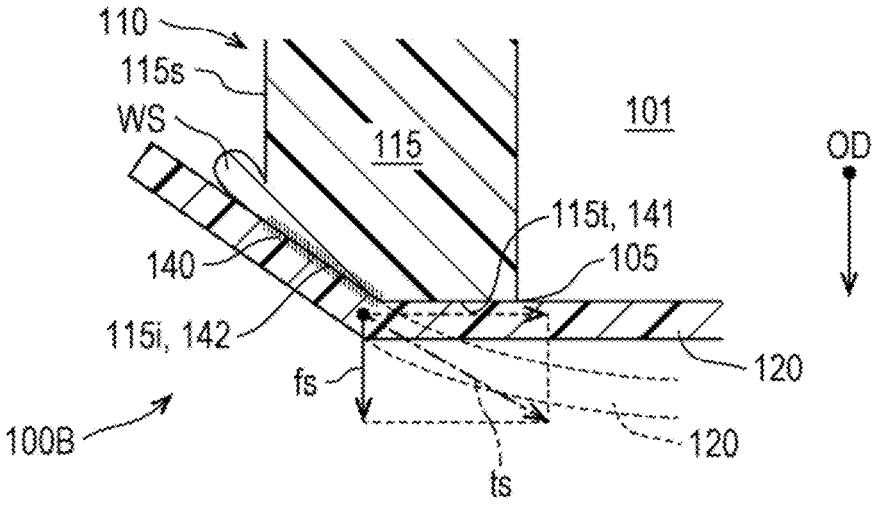
FIG. 12 is a schematic cross-sectional view illustrating a film attachment section of a second embodiment.

FIG. 12 is a schematic cross-sectional view illustrating the film attachment section 140 in a container 100B of a second embodiment. The configuration of the container 100B of the second embodiment is substantially the same as the configuration of the container 100 of the first embodiment except for the configuration of the second surface 142 on which the film attachment section 140 is provided.

According to the container 100B of the second embodiment, the second surface 142 on which the film attachment section 140 is provided is disposed at a notched portion of the corner between the end face 115*t* and the outer peripheral surface 115*s* of the peripheral wall 115. The second surface 142 is provided at a position adjacent to the end face 115*t* on which the first surface 141 is located, and is located on an inclined surface 115*i* that intersects the end face 115*t*.

Figure 13:
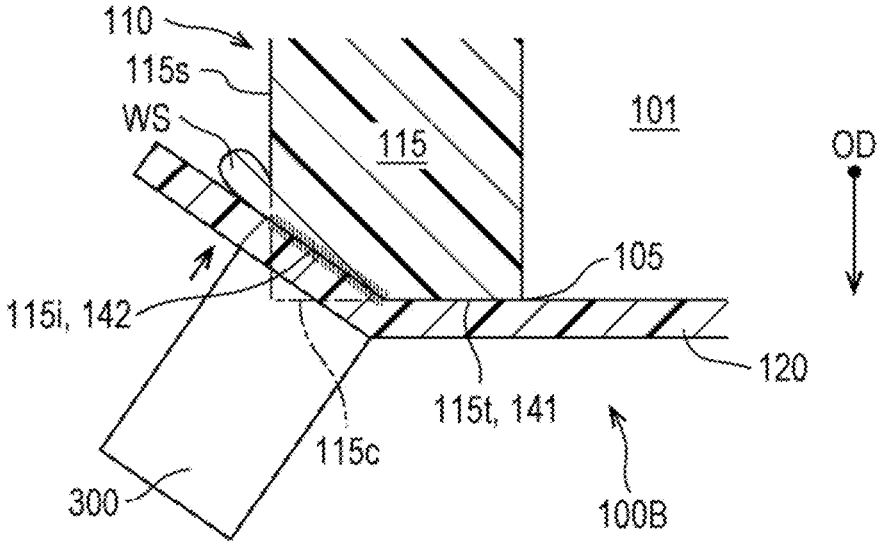
FIG. 13 is a schematic diagram illustrating a method of forming a film attachment section of the second embodiment.

FIG. 13 is a schematic diagram illustrating a method of forming a film attachment section 140 of the second embodiment. In the second embodiment, while the film 120 is positioned on the end face 115*t* of the peripheral wall 115, a planar portion of the heat generating element 300 is pressed against the corner 115*c* of the peripheral wall 115 with the film 120 interposed therebetween in a direction oblique relative to the end face 115*t*. Accordingly, as the corner 115*c* is melted to form the inclined surface 115*i*, the film 120 is welded to the inclined surface 115*i*. With this configuration, the film attachment section 140 can be formed on the second surface 142 located on the inclined surface 115*i*.

According to the container 100B of the second embodiment, as shown in FIG. 12, a force fs in the shear direction along the second surface 142 is generated at the end of the film attachment section 140 on the first surface 141 by a tensile stress is generated when the film 120 is flexibly deformed in the opening direction OD. Therefore, as described in the first embodiment, the film attachment section 140 is prevented from being broken due to flexible deformation of the film 120 and the film 120 is prevented from being peeled from the casing 110. Further, in formation of the film attachment section 140, the film 120 is simply bent at an angle along the inclined surface 115*i*. Accordingly, a load applied to the film 120 in formation of the film attachment section 140 can be reduced. In addition, according to the container 100B of the second embodiment, various effects which are the same as those in the first embodiment can be achieved.

3. Third Embodiment

Figure 14:
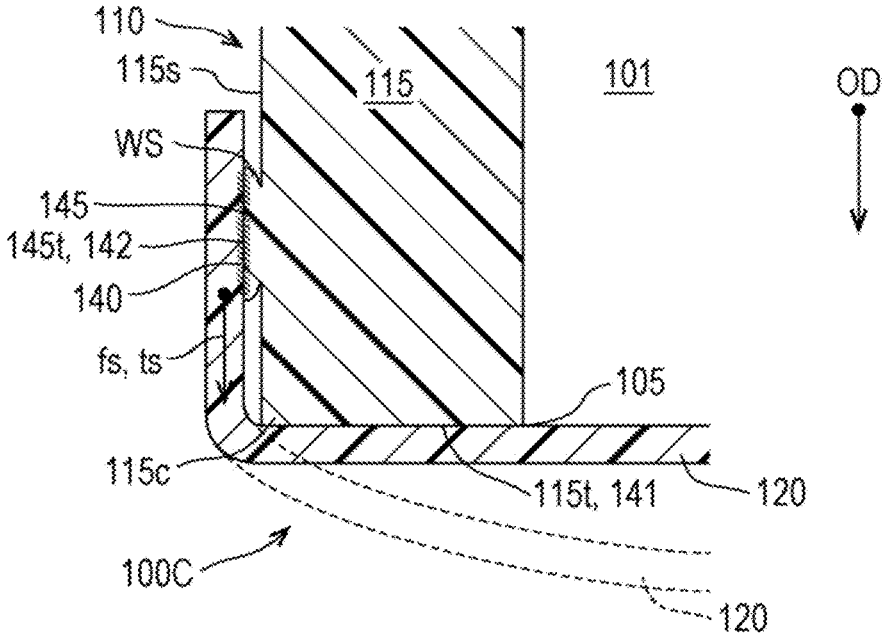
FIG. 14 is a schematic cross-sectional view illustrating a film attachment section of a third embodiment.

FIG. 14 is a schematic cross-sectional view illustrating the film attachment section 140 in a container 100C of a third embodiment. The configuration of the container 100C of the third embodiment is substantially the same as the configuration of the container 100 of the first embodiment except that the corner 115*c* is left on the peripheral wall 115 and the second surface 142 on which the film attachment section 140 is provided is located on a projection 145 of the outer peripheral surface 115*s*.

According to the container 100C of the third embodiment, the projection 145 protruding from the outer peripheral surface 115*s* is provided on the outer peripheral surface 115*s* of the peripheral wall 115. The projection 145 is formed in an annular shape surrounding the outer periphery of the peripheral wall 115. The film 120 is disposed to cover the end face 115*t* of the peripheral wall 115, and the outer periphery portion protruding from the end face 115*t* is folded at the corner 115*c* onto the projection 145 of the outer peripheral surface 115*s*. In the third embodiment as well, the end face 115*t* of the peripheral wall 115 corresponds to the first surface 141, and the film 120 is not fixed to the end face 115*t*. In the third embodiment, a top face 145*t* of the projection 145 that faces the outer periphery portion of the film 120 corresponds to the second surface 142, and the film attachment section 140 is formed of a welding portion between the top face 145*t* of the projection 145 and the film 120.

Figure 15:
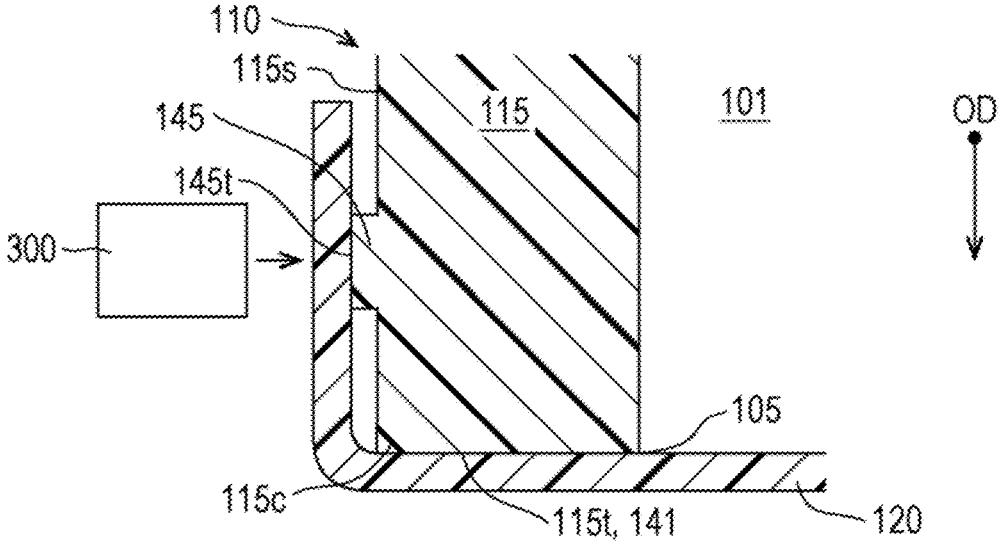
FIG. 15 is a schematic diagram illustrating a method of forming a film attachment section of the third embodiment.

FIG. 15 is a schematic diagram illustrating a method of forming a film attachment section 140 of the third embodiment. In the third embodiment, while the outer periphery portion of the film 120 is positioned on the projection 145 of the outer peripheral surface 115*s*, a planar portion of the heat generating element 300 is pressed against the projection 145 with the outer periphery portion of the film 120 interposed therebetween to thereby melt the projection 145 to be welded to the film 120. Accordingly, as shown in FIG. 14, the film attachment section 140 is formed on the top face 145*t* of the projection 145 of the outer peripheral surface 115*s*. Further, there may be a case where a part of the projection 145 is melted, and sags onto the periphery of the projection 145 to form a weld sag WS after the film attachment section 140 is formed.

According to the container 100C of the third embodiment, as shown in FIG. 14, a tensile stress is generated when the film 120 is flexibly deformed in the opening direction OD acts on the film attachment section 140 as a force fs in the shear direction along the second surface 142. Therefore, as described in the first embodiment, the film attachment section 140 is prevented from being broken due to flexible deformation of the film 120 and the film 120 is prevented from being peeled from the casing 110. In addition, according to the container 100C of the third embodiment, various effects which are the same as those in the above embodiments can be achieved.

4. Fourth Embodiment

Figure 16:
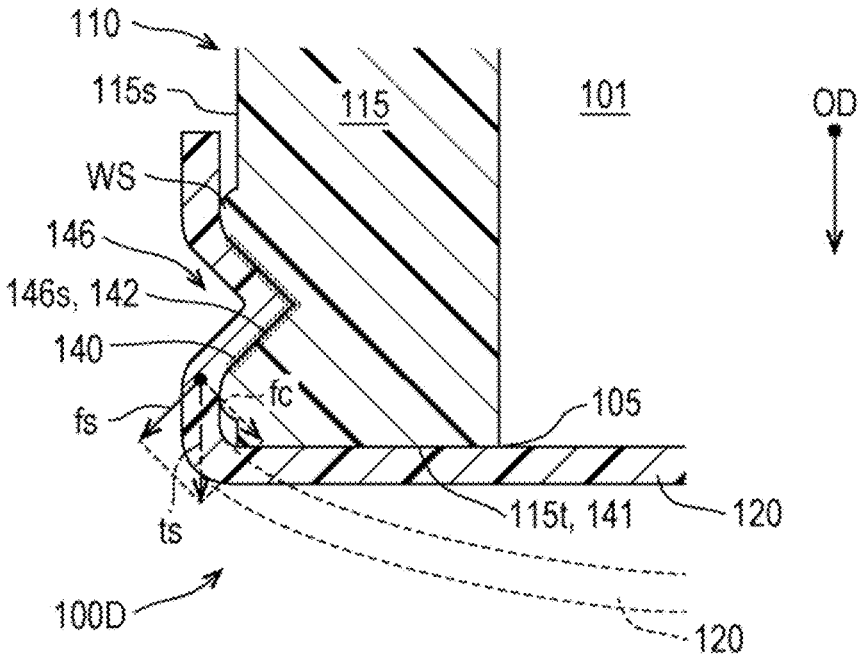
FIG. 16 is a schematic cross-sectional view illustrating a film attachment section of a fourth embodiment.

FIG. 16 is a schematic cross-sectional view illustrating the film attachment section 140 in a container 100D of a fourth embodiment. The configuration of the container 100D of the fourth embodiment is substantially the same as the configuration of the container 100C of the third embodiment except that the second surface 142 on which the film attachment section 140 is provided is located in a recess 146 of the outer peripheral surface 115*s*.

According to the container 100D of the fourth embodiment, the recess 146 recessed toward the storage space 101 is provided on the outer peripheral surface 115*s* of the peripheral wall 115. The recess 146 is formed in an annular shape surrounding the outer periphery of the peripheral wall 115. A part of the outer periphery portion of the film 120 disposed on the outer peripheral surface 115*s* is inserted into the recess 146. In the fourth embodiment as well, the end face 115*t* of the peripheral wall 115 corresponds to the first surface 141, and the film 120 is not fixed to the end face 115*t*. In the fourth embodiment, an inner wall surface 146*s* of the recess 146 that faces the film 120 inserted into the recess 146 corresponds to the second surface 142, and the film attachment section 140 is formed of a welding portion between the inner wall surface 146*s* and the film 120.

Figure 17:
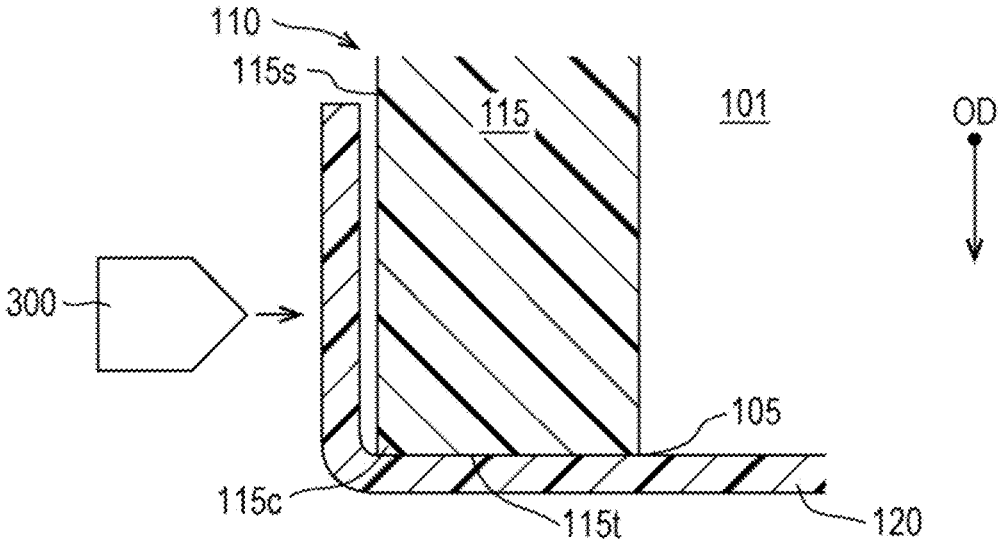
FIG. 17 is a schematic diagram illustrating a method of forming a film attachment section of the fourth embodiment.

FIG. 17 is a schematic diagram illustrating a method of forming a film attachment section 140 of the fourth embodiment. In the fourth embodiment, while the outer periphery portion of the film 120 is positioned on the outer peripheral surface 115*s*, a sharp portion of the heat generating element 300 is pressed against the outer peripheral surface 115*s* with the outer periphery portion of the film 120 interposed therebetween to thereby form the recess 146 and weld the film 120. Accordingly, as shown in FIG. 16, the film attachment section 140 is formed on the inner wall surface

146*s* of the recess 146. There may be a case where a weld sag WS is formed on the periphery of the recess 146.

According to the container 100D of the fourth embodiment, as shown in FIG. 16, a force fs in the shear direction along the second surface 142 is generated on the film attachment section 140 by a tensile stress is generated when the film 120 is flexibly deformed in the opening direction OD. Further, a force fc in a direction from the film 120 toward the second surface 142 is generated. Accordingly, the film 120 is further prevented from being peeled from the casing 110. Further, the container 100D of the fourth embodiment is efficient in that the film attachment section 140 can be formed while forming the recess 146. In addition, according to the container 100D of the fourth embodiment, various effects which are the same as those in the above embodiments can be achieved.

5. Fifth Embodiment

Figure 18:
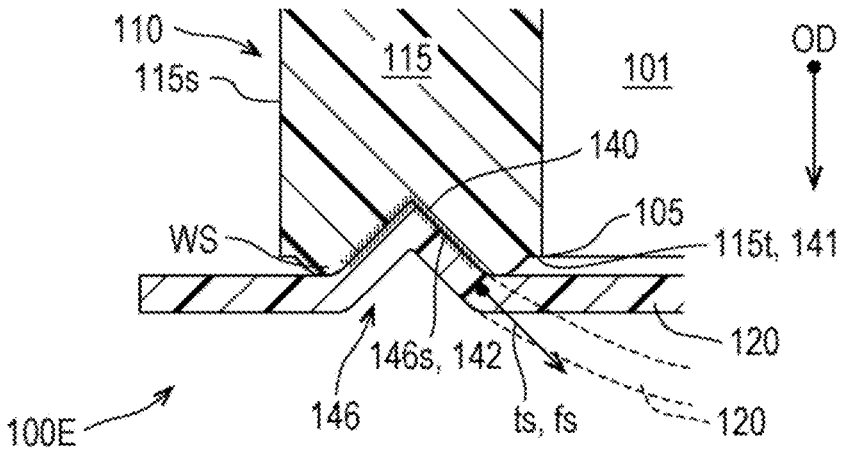
FIG. 18 is a schematic cross-sectional view illustrating a film attachment section of a fifth embodiment.

FIG. 18 is a schematic cross-sectional view illustrating the film attachment section 140 in a container 100E of a fifth embodiment. The configuration of the container 100E of the fifth embodiment is substantially the same as the configuration of the container 100D of the fourth embodiment except that the recess 146 in which the film attachment section 140 is provided is located on the end face 115*t* rather than on the outer peripheral surface 115*s*.

According to the container 100E of the fifth embodiment, the recess 146 recessed in a direction opposite to the opening direction OD is provided on the end face 115*t* of the peripheral wall 115. The recess 146 is formed in an annular shape surrounding the outer periphery of the opening 105. A part of the outer periphery portion of the film 120 is inserted into the recess 146. In the fifth embodiment, the end face 115*t* at the periphery of the recess 146 corresponds to the first surface 141, and the film 120 is not fixed to the end face 115*t*. Further, the inner wall surface 146*s* of the recess 146 corresponds to the second surface 142, and the film attachment section 140 is formed of a welding portion between the inner wall surface 146*s* and the film 120.

Figure 19:
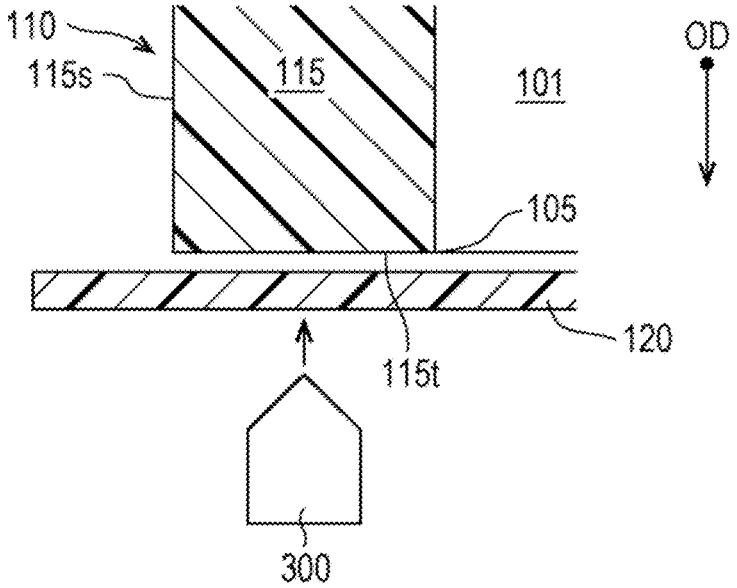
FIG. 19 is a schematic diagram illustrating a method of forming a film attachment section of the fifth embodiment.

FIG. 19 is a schematic diagram illustrating a method of forming a film attachment section 140 of the fifth embodiment. In the fifth embodiment, while the film 120 is positioned on the end face 115*t*, a sharp portion of the heat generating element 300 is pressed against the end face 115*t* with the outer periphery portion of the film 120 interposed therebetween to thereby form the recess 146 and weld the film 120. Accordingly, as shown in FIG. 18, the film attachment section 140 is formed on the inner wall surface 146*s* of the recess 146.

According to the container 100E of the fifth embodiment, as shown in FIG. 18, a tensile stress is generated when the film 120 is flexibly deformed in the opening direction OD acts on the film attachment section 140 as a force fs in the shear direction along the second surface 142. Therefore, the film attachment section 140 is prevented from being broken due to flexible deformation of the film 120 and the film 120 is prevented from being peeled from the casing 110. In addition, according to the container 100D of the fifth embodiment, various effects which are the same as those in the above embodiments can be achieved.

6. Sixth Embodiment

Figure 20:
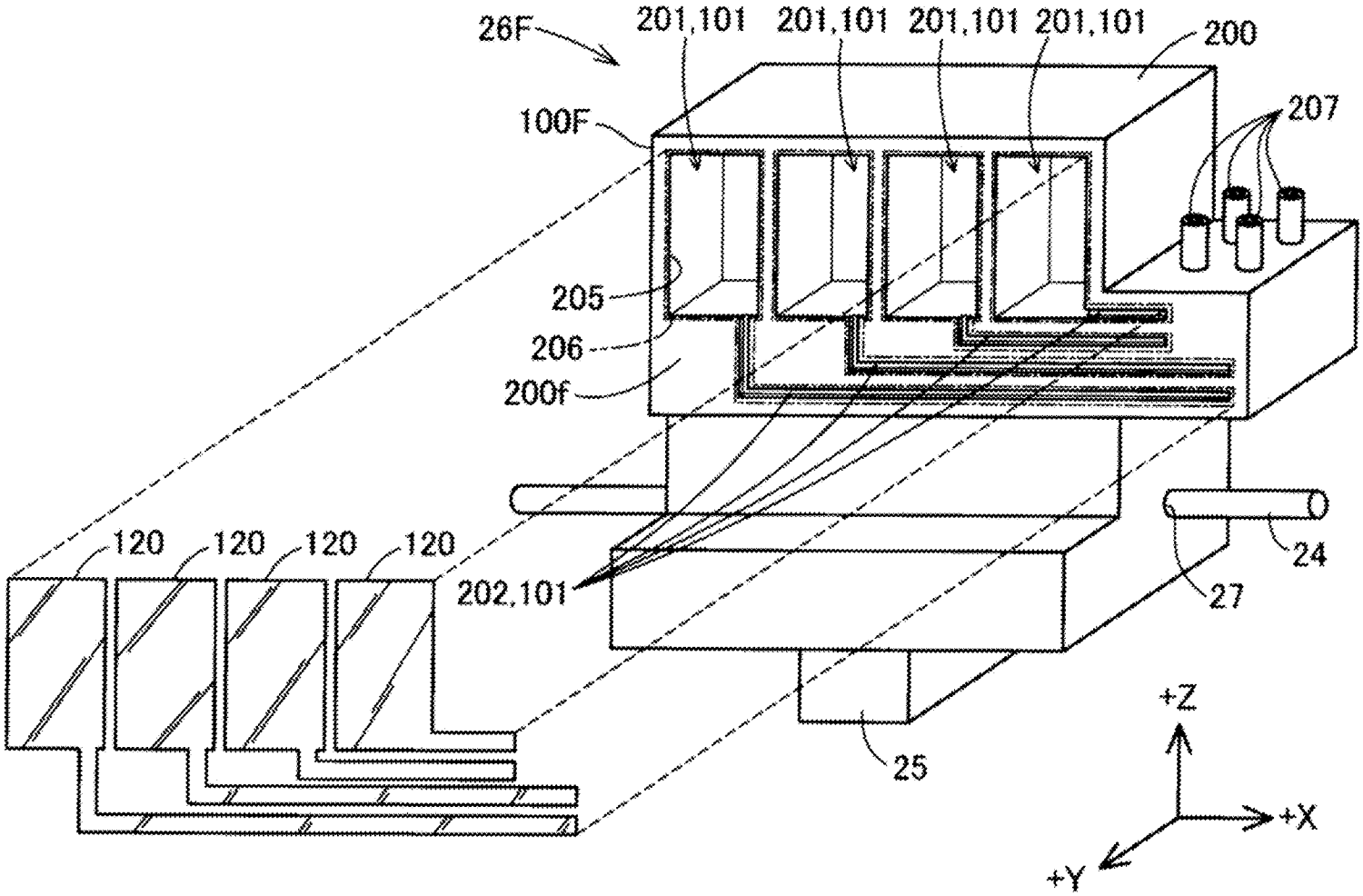
FIG. 20 is a schematic perspective view illustrating a carriage on which a container of a sixth embodiment is mounted.

FIG. 20 is a schematic perspective view illustrating a carriage 26F on which a container 100F of a sixth embodiment is mounted. The carriage 26F is mounted, instead of the carriage 26, on the printer 21 described in the first embodiment and shown in FIG. 1. The container 100F of the sixth embodiment is mounted on the carriage 26F, and stores ink to be supplied via the ink supplying tube 46 shown in FIG. 1.

The container 100F is formed of a rectangular box. The container 100F is mounted in an upper part of the carriage 26F, and reciprocates together with the carriage 26F. The container 100F includes a casing 200 having a rectangular shape that forms a main body. The casing 200 includes, as the storage space 101 for ink, an ink storage portion 201 for storing ink, and an ink flow path 202 for flowing ink into the ink storage portion 201.

Each ink storage portion 201 is provided for a respective one of ink colors, and the ink flow path 202 is provided corresponding to each ink storage portion 201. The ink storage portion 201 and the ink flow path 202 are formed as recesses that are open in the +Y direction in a front face 200*f* oriented in the +Y direction of the casing 200. More specifically, the ink storage portion 201 is formed as a substantially rectangular recess space. The ink flow path 202 is formed as a flow path groove that extends along the front face 200*f* of the casing 200 to a lower end of the ink storage portion 201.

The recess that forms the ink storage portion 201 and the ink flow path 202 is sealed by the film 120. The openings 205 of the recesses that form the respective ink storage portions 201 and the ink flow paths 202 is each surrounded by a rib 206, which corresponds to the peripheral wall 115 described in the first embodiment and shown in FIG. 8. In FIG. 20, the rib 206 is indicated by the dashed and dotted line for convenience. The film 120 is fixed to the rib 206. The method of attaching the film 120 to the casing 200 will be described later.

The container 100F includes tubular connection tubes 207 to which the ink supplying tubes 46 shown in FIG. 1 are coupled. Each connection tube 207 is coupled to one end of the corresponding ink flow path 202 via a flow path (not shown) provided in the casing 200. Further, each ink storage portion 201 in the container 100F is coupled to the recording head 25 via a flow path (not shown) provided in the casing 200. Ink in the ink storage portion 201 is supplied to the recording head 25 by suction of a pump (not shown).

Figure 21A:
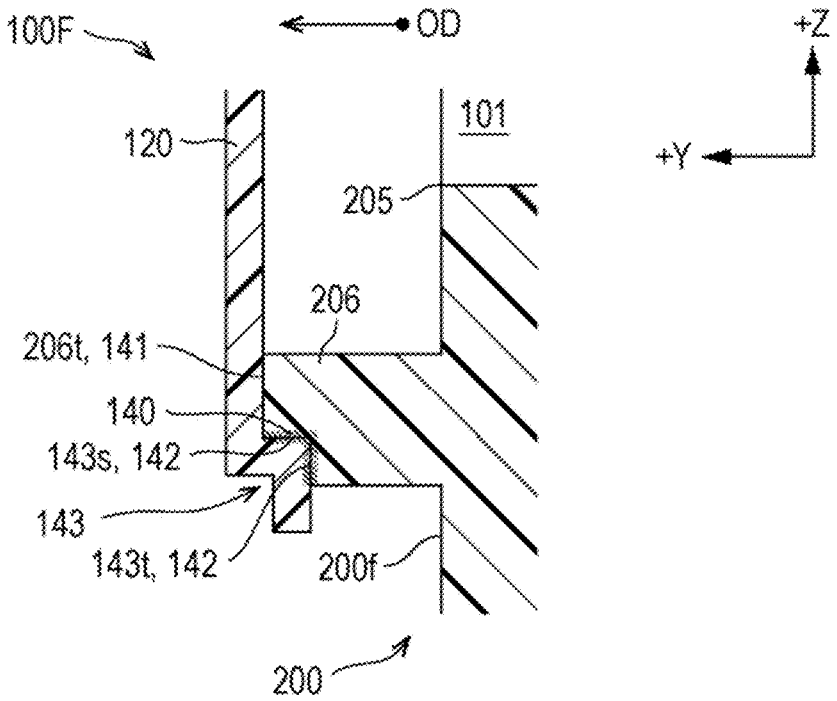
FIG. 21A is a schematic cross-sectional view illustrating a configuration of a film attachment section of the sixth embodiment.

FIG. 21A is a schematic cross-sectional view illustrating a configuration of the film attachment section 140 in the container 100F of the sixth embodiment. As described above, in the container 100F, the film 120 that seals the opening 205 is fixed to the rib 206 surrounding the opening 205. In the sixth embodiment, the film 120 is fixed to the rib 206 by the film attachment section 140 having a similar configuration to that described in the first embodiment. Specifically, the film 120 is not fixed at the first surface 141 located on the end face 206*t* oriented in the +Y direction of the rib 206, and is fixed by the film attachment section 140 provided on the second surface 142 located on the stepped portion 143 provided on the rib 206. Further, in another embodiment, the film 120 may be fixed to the rib 206 by the film attachment section 140 described in the above embodiments other than the first embodiment.

Figure 21B:
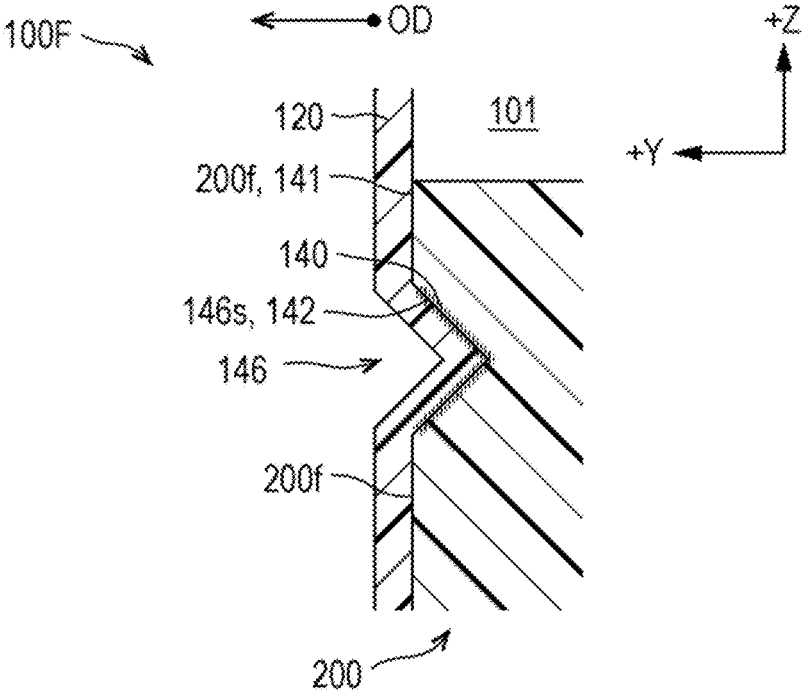
FIG. 21B is a schematic cross-sectional view illustrating another configuration example of a film attachment section of the sixth embodiment.

With reference to FIG. 21B, a method of attaching the film 120 to the casing 200 without using the rib 206 will be described as another configuration example of the container 100F according to the sixth embodiment. When this method is applied, the rib 206 may not be necessarily provided on the front face 200*f* of the casing 200. In this method, the film 120 is welded to the inner wall surface 146*s* of the recess 146 which is formed surrounding the opening 205, and fixed to the casing 200 in a similar manner to that described in the fourth embodiment and the fifth embodiment. In this configuration example, the front surface 200*f* in a region surrounded by the recess 146 corresponds to the first surface 141, and the inner wall surface 146*s* of the recess 146 corresponds to the second surface 142.

According to the container 100F of the sixth embodiment, the film 120 is not fixed to the first surface 141 of the casing 200, and is fixed by the film attachment section 140 provided on the second surface 142. Therefore, as described in the above embodiments, the film 120 is prevented from being peeled from the casing 200. Further, according to the container 100F of the sixth embodiment, part of the wall is formed of the film 120, which reduces the weight, so the energy consumed for reciprocation of the carriage 26F can be reduced. In addition, according to the container 100F of the sixth embodiment, various effects which are the same as those in the above embodiments can be achieved.

7. Seventh Embodiment

Figure 22:
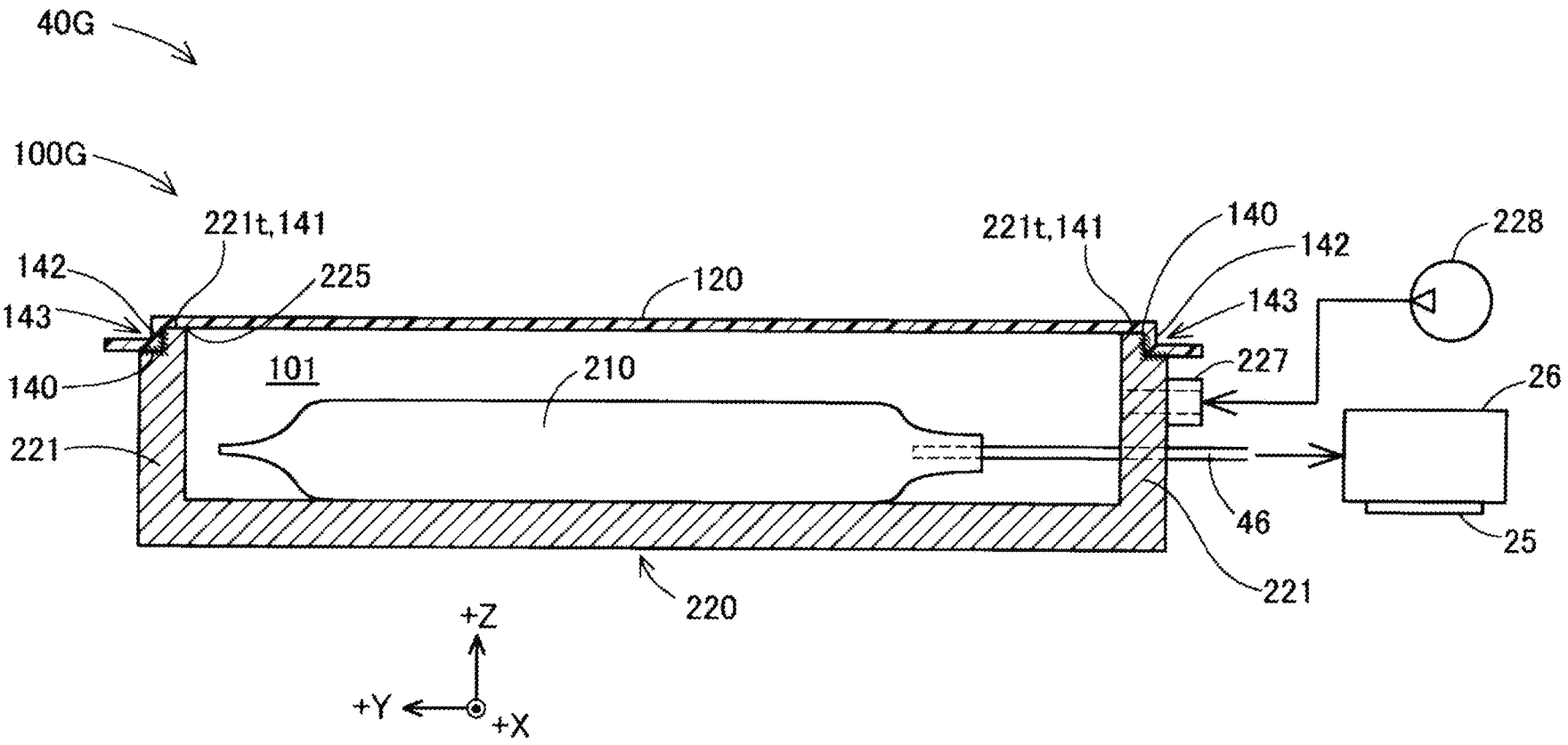
FIG. 22 is a schematic view of an ink supply unit having a container of a seventh embodiment.

FIG. 22 is a schematic view of an ink supply unit 40G having a container 100G of a seventh embodiment. The ink supply unit 40G is mounted, instead of the ink supply unit 40, on the printer 21 described in the first embodiment and shown in FIG. 1.

In the ink supply unit 40G, an ink pack 210 is housed in the storage space 101 of the container 100G. The ink pack 210 is formed of a flexible bag, and stores ink. The ink pack 210 is coupled to the recording head 25 mounted on the carriage 26 via the ink supplying tube 46.

The container 100G includes a casing 220, which is formed of a hollow box made of a resin. The storage space 101 of the container 100G is formed by an inner space of the casing 220. The casing 220 has an opening 225 that opens in the +Z direction. The opening 225 is hermetically sealed by the film 120. The peripheral wall 221 surrounding the opening 225 of the casing 220 corresponds to the peripheral wall 115 described in the first embodiment. In the seventh embodiment, the film 120 is fixed to the peripheral wall 221 of the casing by the film attachment section 140 having a similar configuration to that described in the first embodiment. Specifically, the film 120 is not fixed at the first surface 141 located on an end face 221*t* oriented in the +Z direction of the peripheral wall 221, and is fixed by the film attachment section 140 provided on the second surface 142 located on the stepped portion 143 provided on the end of the peripheral wall 221. Further, in another embodiment, the film 120 may be fixed to the casing 220 by the film attachment section 140 described in the above embodiments other than the first embodiment.

The container 100G is coupled to a pump 228 provided in the printer 21 via an air pipe 227. The pump 228 supplies pressurized air into the storage space 101 of the container 100G. In the ink supply unit 40G, as the ink pack 210 is pressurized by pressurized air supplied into the storage space 101, ink in the ink pack 210 is pushed into the ink supplying tube 46, and supplied to the recording head 25.

According to the container 100G of the seventh embodiment, the film 120 is not fixed to the first surface 141 of the casing 220, and is fixed by the film attachment section 140 provided on the second surface 142. Therefore, even when flexible deformation of the film 120 is repeated by a pressure change due to the pressurized air being supplied into the storage space 101 of the container 100G, the film 120 is prevented from being peeled from the casing 200 as described in the above embodiments. Further, according to the container 100G of the seventh embodiment, part of the wall of the container 100G is formed of the film 120, which reduces the weight of the ink supply unit 40G. In addition, according to the container 100G of the seventh embodiment, various effects which are the same as those in the above embodiments can be achieved.

8. Eighth Embodiment

Figure 23:
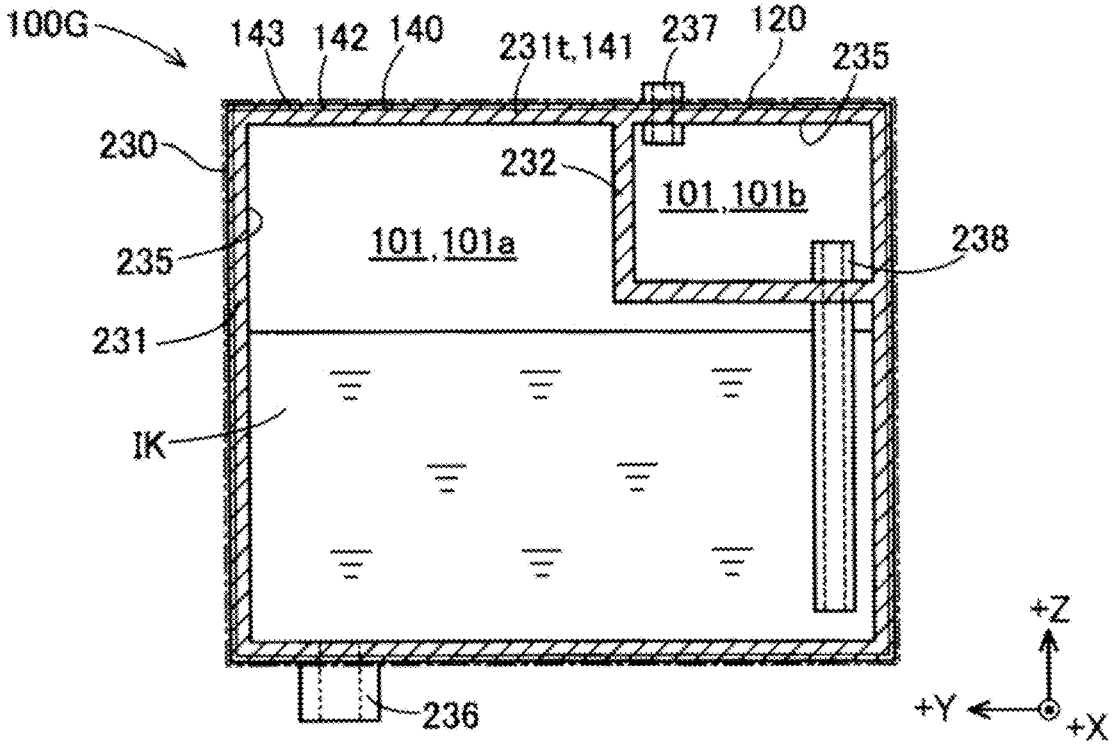
FIG. 23 is a schematic view illustrating a configuration of an eighth embodiment.

FIG. 23 is a schematic view illustrating a configuration of the container 100G of an eighth embodiment. The container 100G of the eighth embodiment is configured as an ink cartridge. In the eighth embodiment, the carriage 26 of the printer 21 is configured such that the container 100G can be mounted thereon, instead of being coupled to the ink supplying tube 46. Further, in the eighth embodiment, the ink supply unit 40 of the printer 21 is omitted.

The container 100G includes a casing 230 that forms a main body. The casing 230 is configured as a box having an opening 235 that opens in the +X direction. The inner space of the casing 230 forms the storage space 101 for storing the ink IK and air. The casing 230 has a peripheral wall 231 surrounding the opening 235 that communicates with the storage space 101.

The storage space 101 in the container 100G stores the ink IK and air at atmospheric pressure. The storage space 101 is divided into an ink chamber 101*a* for storing air and ink, and an air chamber 101*b*, provided on the upper side of the ink chamber 101*a*, for storing air. The ink chamber 101*a* and the air chamber 101*b* are divided by a partition 232. The partition 232 divides the opening 235 of the casing 230 into a region communicating with the ink chamber 101*a*, and a region communicating with the air chamber 101*b*.

An ink discharge portion 236 for discharging the ink IK in the ink chamber 101*a* is provided at a lower end of the ink chamber 101*a*. The ink discharge portion 236 is coupled to the recording head 25 when the container 100G is mounted on the carriage 26.

An atmospheric opening section 237 for introducing air into the air chamber 101*b* is provided on the upper end of the air chamber 101*b*. The air chamber 101*b* is coupled to the ink chamber 101*a* via an air tube 238. As the ink IK in the ink chamber 101*a* is consumed, air in the air chamber 101*b* flows into the ink chamber 101*a* via the air tube 238.

In the container 100G, the air tube 238 protrudes from the bottom of the air chamber 101*b*. Accordingly, even when the ink IK in the ink chamber 101*a* flows into the air chamber 101*b* via the air tube 238 and is stored in the air chamber 101*b*, the air tube 238 is prevented from being closed by the ink IK.

In the container 100G, the opening 235 of the casing 230 is sealed by the film 120. In FIG. 23, a region for positioning the film 120 is indicated by the dashed and dotted line for convenience. The film 120 is fixed to the casing 230 by the film attachment section 140 provided on the peripheral wall 231. In the eighth embodiment, an end face 231*t* oriented in the +X direction of the peripheral wall 231 corresponds to the first surface 141. In the eighth embodiment, as described in the first embodiment, the stepped portion 143 having the second surface 142 on which the film attachment section 140 is provided is formed at the end of the peripheral wall 231. Further, in another embodiment, the film 120 may be fixed to the peripheral wall 231 by the film attachment section 140 having a configuration described in the above embodiments other than the first embodiment.

According to the container 100G of the eighth embodiment, the film 120 is fixed by the film attachment section 140 provided on the peripheral wall 231 of the casing 230. Therefore, as described in the above embodiments, the film 120 is prevented from being peeled from the casing 230. In addition, according to the container 100G of the eighth embodiment, various effects which are the same as those in the above embodiments can be achieved.

9. Other Embodiments

The various configurations described in the above embodiments can be modified as follows, for example. Other embodiments described below are regarded as example forms for implementing the techniques of the present disclosure as with the above embodiments.

Other Embodiment 1

In the above embodiments, the film attachment section 140 may be formed by a method other than welding. The film attachment section 140 may be formed of, for example, an adhesive.

Other Embodiment 2

The container of the present disclosure may store, as a fluid, other than ink, atmospheric air, or pressurized air as a fluid for use in an ink jet printer. The container of the present disclosure may store, as a fluid, liquid other than ink or gas other than air. The "liquid" described in the present disclosure includes liquid state materials such as materials having high or low viscosity, sol, gel water, other inorganic solvents, organic solvents, solutions, liquid resins, liquid metal including metal melt. The "liquid" further includes materials in which particles of a functional material having solids such as pigments and metal particles are dissolved, dispersed, or mixed in a solvent, as well as liquid as one state of substances. In addition, representative examples of the liquid include ink described in the above embodiments, liquid crystals, oil and the like. Here, the "ink" is intended to include general water-based ink, oil-based ink, and various types of liquid compositions such as dye ink, pigment ink, gel ink, and hot melt ink.

10. Variations

The techniques of the present disclosure are not limited to the above embodiments and examples, and can be embodied in various forms without departing from the spirit thereof. For example, the techniques of the present disclosure can be implemented as the following forms. Technical features in the above embodiments corresponding to the technical features in the respective forms described below can be appropriately replaced or combined in order to solve all or part of the problems that should be overcome by the techniques of the present disclosure, or achieve all or part of the effects that should be performed by the techniques of the present disclosure. Further, technical features can be appropriately deleted unless they are described as indispensable features in the specification.

(1) According to a first aspect, a container that stores a fluid for use in an ink jet printer is provided. The container according to the aspect includes: a casing that defines a storage space for storing the fluid, and has an opening communicating with the storage space; a film that covers the opening and seals the storage space; and a film attachment section that fixes the film to the casing, wherein the casing includes a first surface that surrounds a periphery of the opening, and faces the film, and a second surface that surrounds the opening at a position farther from the opening than the first surface, has an angle intersecting the first surface, and faces the film, and the film attachment section is provided on the second surface, and the film is not fixed to the first surface. According to the container of this form, when the film is flexibly deformed, a force in the direction in which the film is peeled from the second surface is less likely to occur, so the film can be prevented from being peeled from the casing.

(2) In the container of the above aspect, the casing may have a peripheral wall that surrounds the opening, and extends in an opening direction, which is a direction from an inside to an outside of the storage space through the opening, the first surface may be located on an end face of the peripheral wall, and the second surface may be located on a wall surface of the peripheral wall, which is located on a side, relative to the first surface, in a direction from the film toward the casing. According to the container of this form, the film can be prevented from being peeled from the peripheral wall.

(3) In the container of the above aspect, the second surface may be provided at a notched portion of a corner between an outer peripheral surface of the peripheral wall on a side opposite to that facing the storage space and the end face. According to the container of this form, the second surface on which the film attachment section is provided can be easily formed on the peripheral wall.

(4) In the container of the above aspect, the second surface may be provided on an outer peripheral surface of the peripheral wall on a side opposite to that facing the storage space. According to the container of this form, the film can be prevented from being peeled from the peripheral wall.

(5) In the container of the above aspect, the second surface may be provided on a projection of the outer peripheral surface. According to the container of this form, the second surface can be easily formed on the outer peripheral surface of the peripheral wall.

(6) In the container of the above aspect, the second surface may be provided in a recess of the outer peripheral surface. According to the container of this form, the second surface can be easily formed on the outer peripheral surface of the peripheral wall.

(7) In the container of the above aspect, the second surface may be provided in a recess formed on the end face. According to the container of this form, the second surface can be easily formed on the end face of the peripheral wall.

(8) In the container of the above aspect, the storage space may store, as the fluid, ink for use in the ink jet printer. According to the container of this form, ink leakage due to peeling of the film can be prevented.

(9) In the container of the above aspect, the storage space may store, as the fluid, pressurized air that is pressurized by a pump included in the ink jet printer. According to the container of this form, peeling of the film from the casing due to flexible deformation of the film by pressurized air can be prevented.

11. Others

The techniques of the present disclosure can also be implemented in various forms other than a container that stores a fluid for use in an ink jet printer. For example, the techniques of the present disclosure can also be implemented in the forms such as a method of attaching a film to an ink jet printer, a printing system, a casing having the above container.

What is claimed is:

1. A container that stores a fluid for use in an ink jet printer, the container comprising:

a casing that defines a storage space for storing the fluid, and has an opening communicating with the storage space, the casing having a first end portion and a second end portion that is opposed to the first end portion and is separated from the first end portion by the storage space, the opening being located at the second end portion;

a liquid conduit located at the first end portion and configured to pass the fluid from the storage space outside of the container;

a film arranged at the second end portion and configured to cover the opening and seal the storage space at the second end portion; and a film attachment section arranged at the second end portion and configured to fix the film to the casing, wherein the casing includes a peripheral wall extending in an axial direction along a central axis of the container, the peripheral wall having an inner side facing the storage space, an outer side facing an exterior of the storage space and an end face in the axial direction, the end face of the peripheral wall has a first surface that surrounds a periphery of the opening, and faces the film, the outer side of the peripheral wall has a second surface that surrounds the opening at a position farther from the opening than the first surface, that has a portion at an angle intersecting the first surface, and that faces the film, and the film is welded to the second surface and not welded to the first surface.

2. The container according to claim 1, wherein the second surface is provided at a notched portion of a corner between the outer side and the end face of the peripheral wall.

3. The container according to claim 1, wherein the second surface is provided on a portion of the outer side of the peripheral wall in opposition to the storage space.

4. The container according to claim 1, wherein the second surface is provided on a projection of the outer side of the peripheral wall.

5. The container according to claim 1, wherein the second surface is provided in a recess of the outer side of the peripheral wall.

6. The container according to claim 1, wherein the second surface is provided in a recess formed on the end face of the peripheral wall.

7. The container according to claim 1, wherein the storage space stores, as the fluid, ink for use in the ink jet printer.

8. The container according to claim 1, wherein the storage space stores, as the fluid, pressurized air that is pressurized by a pump included in the ink jet printer.

9. A container that stores a fluid for use in an ink jet printer, the container comprising:

a casing that defines a storage space for storing the fluid, and has an opening communicating with the storage space; and a film that covers the opening and seals the storage space, wherein the casing includes a peripheral wall, the peripheral wall having an inner side facing the storage space, an outer side facing an exterior of the storage space and an end face, the end face of the peripheral wall has a first surface that surrounds a periphery of the opening, and faces the film, the outer side of the peripheral wall has a second surface that surrounds the opening at a position farther from the opening than the first surface, that has a portion at an angle intersecting the first surface, and that faces the film, and the film is welded to the second surface and not welded to the first surface.

10. The container according to claim 9, wherein the second surface is provided on a projection of the outer side of the peripheral wall.

11. The container according to claim 9, wherein the second surface is provided in a recess of the outer side of the peripheral wall.

12. The container according to claim 9, wherein the second surface is provided at a notched portion of a corner between the outer side and the end face of the peripheral wall.

13. The container according to claim 9, wherein the second surface is provided on a portion of the outer side of the peripheral wall in opposition to the storage space.

14. The container according to claim 9, wherein the second surface is provided in a recess formed on the end face of the peripheral wall.

15. The container according to claim 9, wherein the storage space stores, as the fluid, ink for use in the ink jet printer.

16. The container according to claim 9, wherein the storage space stores, as the fluid, pressurized air that is pressurized by a pump included in the ink jet printer.

* * * * *